US009644436B2

(12) United States Patent
Hoult et al.

(10) Patent No.: US 9,644,436 B2
(45) Date of Patent: May 9, 2017

(54) DRILLING TOOL STORAGE DEVICE AND METHOD OF CHANGING A DRILLING TOOL

(71) Applicant: Caterpillar Global Mining Equipment LLC, South Milwaukee, WI (US)

(72) Inventors: Ross L. Hoult, Eight Mile Plains (AU); Samuel C. Taylor, Bungendore (AU); Andrew Wright, Newcastle (AU); Jason P. O'Brien, Orange (AU); Mark R. Lawler, Largs (AU); Kayne D. Taylor, Bungendore (AU)

(73) Assignee: Caterpillar Global Mining Equipment LLC, Denison, TX (US)

( * ) Notice: Subject to any disclaimer, the term of this patent is extended or adjusted under 35 U.S.C. 154(b) by 793 days.

(21) Appl. No.: 13/964,829

(22) Filed: Aug. 12, 2013

(65) Prior Publication Data

US 2014/0083774 A1 Mar. 27, 2014

Related U.S. Application Data

(60) Provisional application No. 61/704,329, filed on Sep. 21, 2012.

(51) Int. Cl.

| | |
|---|---|
| ***E21B 19/20*** | (2006.01) |
| ***E21B 19/15*** | (2006.01) |
| ***E21B 19/00*** | (2006.01) |
| ***E21B 17/00*** | (2006.01) |
| ***E21B 15/00*** | (2006.01) |

(52) U.S. Cl.
CPC ..... *E21B 19/15* (2013.01); *E21B 15/003* (2013.01); *E21B 17/00* (2013.01); *E21B 19/00* (2013.01); *E21B 19/20* (2013.01)

(58) Field of Classification Search
USPC ..... 414/22.56, 22.67, 22.71
See application file for complete search history.

(56) References Cited

U.S. PATENT DOCUMENTS

| | | | | |
|---|---|---|---|---|
| 3,493,061 | A * | 2/1970 | Gyongyosi | E21B 19/146 175/52 |
| 3,795,326 | A * | 3/1974 | Neilon | E21B 19/155 414/22.58 |
| 3,977,480 | A | 8/1976 | Hilding | |
| 4,470,740 | A * | 9/1984 | Frias | E21B 19/15 414/22.61 |
| 7,469,754 | B2 * | 12/2008 | Landry | E21B 15/04 173/185 |
| 7,886,846 | B2 | 2/2011 | Pires | |

(Continued)

*Primary Examiner* — Cathleen Hutchins
*Assistant Examiner* — Ronald Runyan

(57) ABSTRACT

A drilling tool changer apparatus for a drilling rig includes a drill tower pivotable between a drilling orientation and a change-out orientation, the drill tower supporting a drill string comprising a drill pipe coupled to a drilling tool. The drilling tool changer apparatus also includes a drilling tool storage device pivotally movable about a hinge axis between a stowed position and a deployed position. The drilling tool storage device includes a drilling tool storage cassette including a replacement drilling tool. The drilling tool storage device and the drill tower are pivotally alignable in a substantially co-planar manner when the drilling tool storage device is in the deployed position and the drill tower is in the change-out orientation.

18 Claims, 28 Drawing Sheets

(56) References Cited

U.S. PATENT DOCUMENTS

| | | | | |
|---|---|---|---|---|
| 2006/0162963 | A1 | 7/2006 | Hagemeyer et al. | |
| 2007/0193749 | A1* | 8/2007 | Folk | E21B 7/02 166/379 |

* cited by examiner 18
12
64
48
44
22

64
44
12
48
22

18
12
68
22
42
20
54
56
48
44

FIG. 28
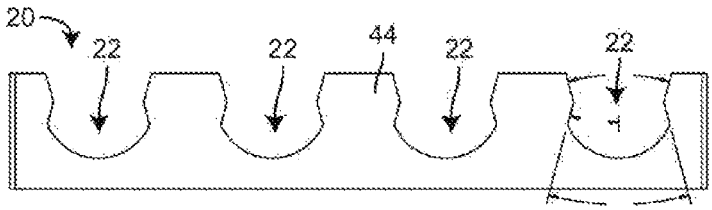
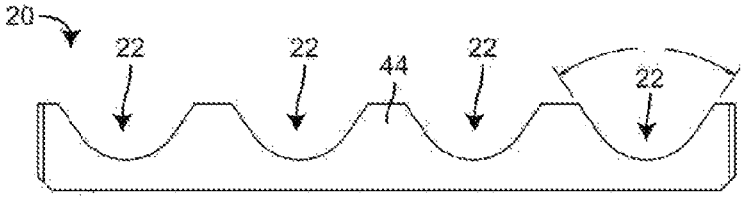
FIG. 29
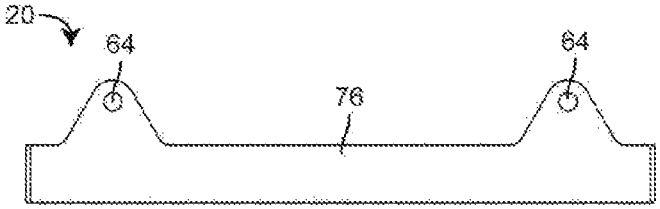
FIG. 30

DRILLING TOOL STORAGE DEVICE AND METHOD OF CHANGING A DRILLING TOOL

CROSS-REFERENCE TO RELATED APPLICATIONS

This application claims the benefit of priority to U.S. Provisional Patent Application No. 61/704,329, which was filed on Sep. 21, 2012, the complete disclosure of which is incorporated by reference herein.

TECHNICAL FIELD

This disclosure relates to drilling systems and more particularly to a drilling tool changer apparatus for use in applications such as mining, blast-hole drilling and other down-hole drilling applications (e.g. petroleum, natural gas, wells, etc.).

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Drilling systems are generally known to include a vertical drill tower (e.g. mast, etc.) constructed from structural members such as steel beams and reinforcing supports. The drill tower is often coupled to a mobile platform (e.g. which along with other components typically form a drilling rig) for positioning the drill tower in a desired location to conduct a drilling operation. The drill tower is often equipped with a drill carousel which is structured and adapted to support a drill string formed from a combination of drill extenders (e.g. drill rods, drill pipes, etc.). The drill carousel is used to selectively add the drill extenders to the drill string for drilling a hole having a desired depth. The drill carousel is intended to allow a drilling operation to progress into the drill hole by making readily available a continuous string of drill extenders as needed for advancing a drilling tool into a drill hole.

The initial (e.g. the first and therefore lowermost) drill extender in the drill string is configured to receive a drilling tool at its lower end to conduct the drilling operation. The drilling tool is usually a drill bit (such as a tricone drill bit) or a 'down the hole' hammer (e.g. hammer tool—for fracturing substrate such as rock formations, etc.). After a certain amount of usage in the drilling operation it is often desirable or necessary to change (e.g. remove, replace, change-out, etc.) the drilling tool due to (for example) accumulated wear of an in-service drill bit, the need to change between a drill bit and a hammering tool (or vice versa), etc. In order to minimize downtime in the drilling operation due to change-out of drilling tools, mechanisms may be provided to facilitate removing one drilling tool from the end of the drilling string and replacing it with another drilling tool from a storage or supply location.

One example of such a mechanism is shown in U.S. Pat. No. 3,977,480 which generally shows a magazine for storing drill bits and a swingable arm to facilitate transfer of the drill bits between the magazine and the drill string. Another example of such a mechanism is shown in U.S. Patent Application Publication No. 2006/0162963 which generally shows a magazine for storing drill bits and a swingable arm having a rotatable carousel on one end to facilitate transfer of the drill bits between the magazine and the drill string. Another example is U.S. Pat. No. 7,886,846 which discloses a rotary carousel device. However, the disclosed mechanisms generally require a large amount of space to accommodate swinging of the arm and/or rotation of the carousel, and are not readily adaptable for use in an automated or semi-automated manner to improve service access from the ground to minimize downtime during change-outs and to minimize the number of personnel required at the drilling rig.

SUMMARY

An embodiment of the present disclosure relates to a drilling tool changer apparatus for a drilling rig. The drilling tool changer apparatus includes a drill tower pivotable between a drilling orientation and a change-out orientation, the drill tower supporting a drill string comprising a drill pipe coupled to a drilling tool. The drilling tool changer apparatus also includes a drilling tool storage device pivotally movable about a hinge axis between a stowed position and a deployed position. The drilling tool storage device includes a drilling tool storage cassette including a replacement drilling tool. The drilling tool storage device and the drill tower are pivotally alignable in a substantially coplanar manner when the drilling tool storage device is in the deployed position and the drill tower is in the change-out orientation.

Another embodiment of the present disclosure relates to a drilling tool storage device. The drilling tool storage device includes a substantially rectangular outer frame having a hinge mechanism that permits the drilling tool storage device to be pivotally raised about a hinge axis between a stowed position and a change-out position, rails extending substantially parallel to the hinge axis and fixed to opposite sides of the substantially rectangular outer frame, a laterally translatable carriage coupled to the rails, a storage cassette removably coupled to the laterally translatable carriage and having a storage receptacle supporting a replacement drilling tool, an actuator operable to extend and retract in order to shift the laterally translatable carriage along the rails, and a cradle configured to support and facilitate alignment of a drill pipe with the replacement drilling tool and the storage receptacle during a change-out operation.

Another embodiment of the present disclosure relates to a method for changing a drilling tool for a drilling rig. The method includes withdrawing a drill pipe coupled to a used drilling tool away from a drill hole to a break-out position, loosening the used drilling tool from the drill pipe, withdrawing the drill pipe and the used drilling tool further away from the drill hole to a retracted position, moving a cover panel from a closed position to an open position, pivoting the drill pipe from a drilling orientation to a change-out orientation, and extending the drill pipe and the used drilling tool to a change-out position. In this embodiment, the method also includes raising a drilling tool storage device from a stowed position to a deployed position to receive the used drilling tool in an empty storage receptacle within the drilling tool storage device, rotating the drill pipe to decouple the drill pipe from the used drilling tool, withdrawing the drill pipe to a standby position, indexing a carriage to align a replacement drilling tool with the drill pipe, extending and rotating the drill pipe into engagement with the replacement drilling tool, lowering the drilling tool storage device from the deployed position to the stowed position, withdrawing the drill pipe and the replacement drilling tool to the retracted position, moving the drill pipe from the change-out orientation to the drilling orientation, extending the drill pipe and the replacement drilling tool to an extended position and tightening the replacement drilling tool on the drill pipe, and moving the cover panel from the open position to the closed position and re-commencing a drilling operation.

BRIEF DESCRIPTION OF THE DRAWINGS

The disclosure will become more fully understood from the following detailed description, taken in conjunction with the accompanying figures, wherein like reference numerals refer to like elements, in which:

FIGS. 24-33 are schematic diagrams of the drilling tool storage device, according to an exemplary embodiment.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring to the Figures, a drill changer apparatus and method for use with a rotary drilling machine such as a drilling rig (or other suitable mobile or stationary drilling system) are shown according to an exemplary embodiment for use in mining, excavation, wells, blast hole drilling or other drilling or boring operations. Although the drill changer apparatus and method are shown and described by way of example as being used with a mobile drilling rig with a local operator cab, the drill changer apparatus of the present disclosure is suitable for use with any of a wide variety of other mobile or stationary drilling systems, which may be locally or remotely operated and controlled. All such variations are intended to be within the scope of this disclosure.

Figure 1:
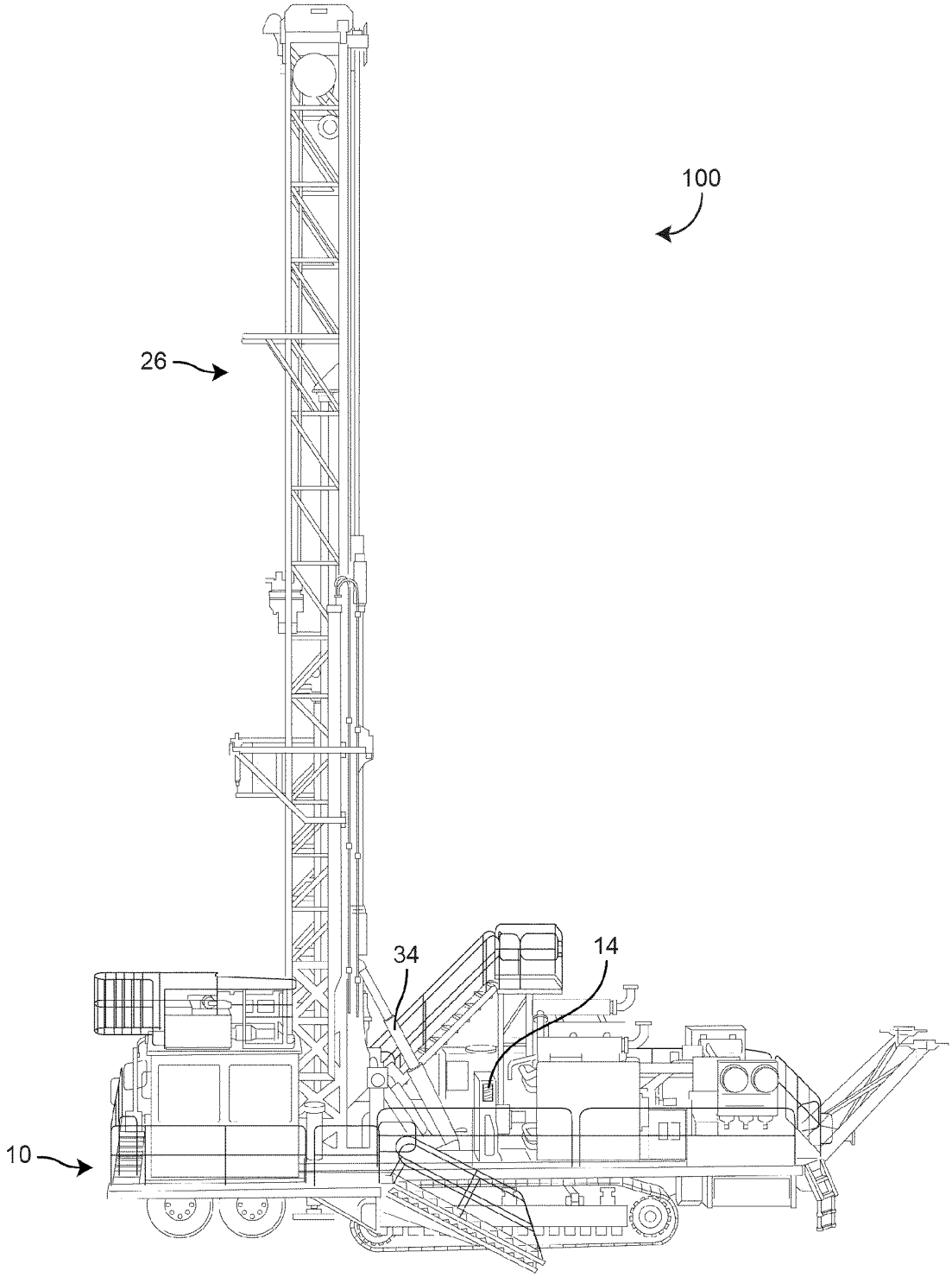
FIG. 1 is a schematic image of a drilling rig, according to an exemplary embodiment of the present disclosure.

Referring to FIG. 1, a drilling rig 100 having a drilling tool changer apparatus 10 is shown according to an exemplary embodiment for use with a rotary drilling machine such as the drilling rig 100. The drilling tool changer apparatus 10 to be further described herein (and shown in further detail in FIGS. 6-20) is intended to more readily facilitate the automatic or semi-automatic (e.g., at least semi-automated) change-out of drilling tools 12 (e.g., tools) (shown in FIG. 2) in response to remotely controlled and/or automated instructions received from a drilling control device 14 (e.g. drilling or mining command/control center, an operator with a computer-based user interface, such as a touchscreen or the like, that wirelessly communicates with the apparatus 10, etc.). The drilling control device 14 may include a programmable logic controller (PLC). In one embodiment, the drilling control device 14 may be coupled to the drilling rig 100 and located such that the drilling control device 14 is accessible to an operator of the drilling rig 100. The drilling control device 14 may also receive feedback data (e.g. equipment status, drilling tool locations, exceptions, alarms, etc.) from the apparatus 10, and/or permit monitoring of the actions/status of the apparatus 10. The drilling control device 14 may also monitor and keep track of drilling tool loading position, drilling tool history, and details of the drilling tools 12 (e.g. serial numbers, footage, wear, etc.). The drilling control device 14 is also programmed with sufficient interlocks and equipment status checks to prevent operation of certain functions that may cause interference or conflict among the components of the apparatus 10 or a drill string 16 (shown in FIG. 2).

Figure 25:
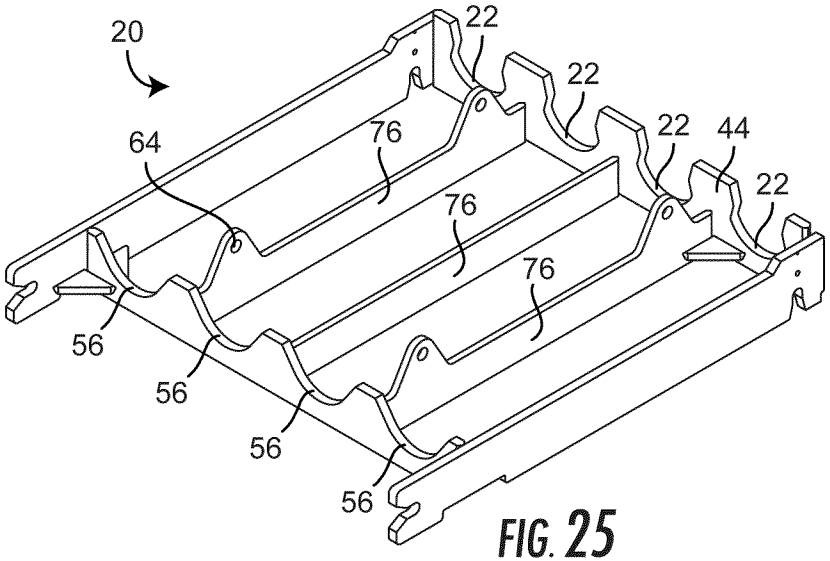
Figure 27:
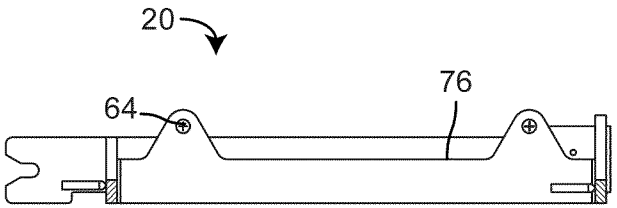
Figure 24:
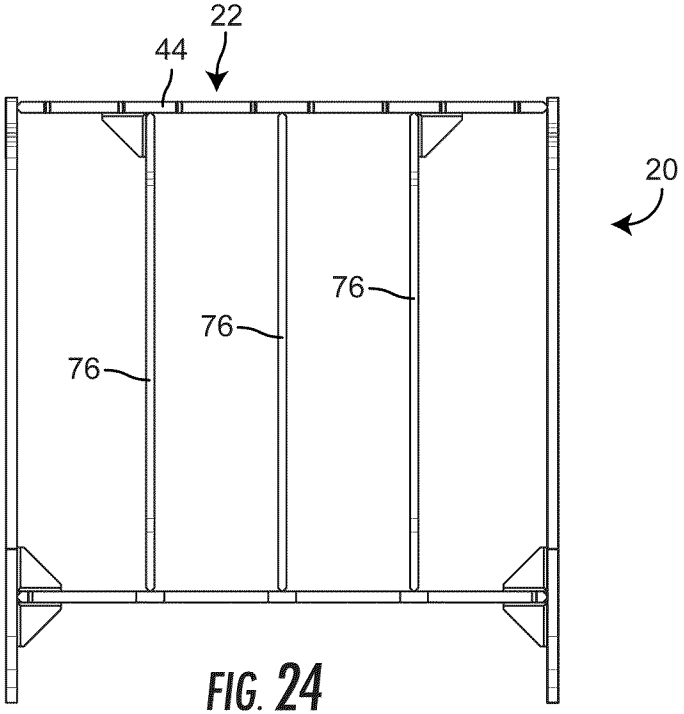
Figure 26:
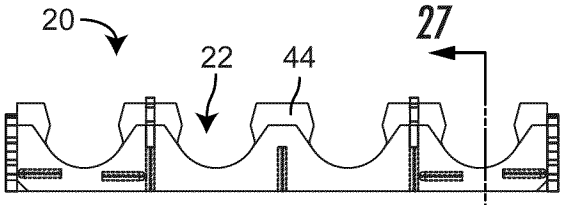
Figure 31:
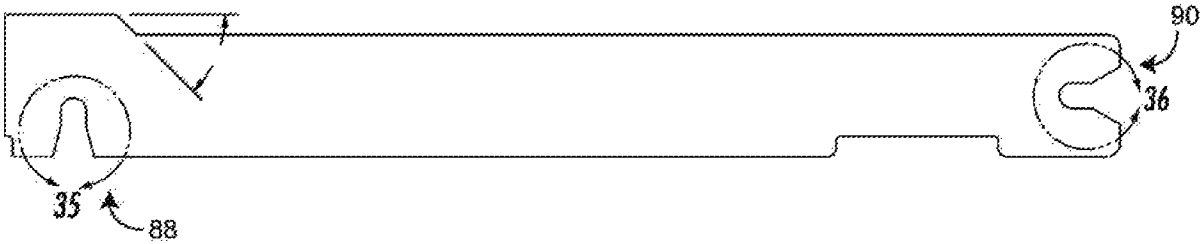
Figure 32:
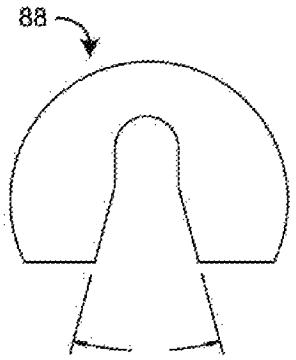
Figure 33:
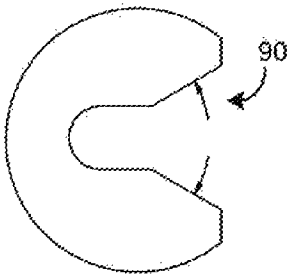
Figure 39:
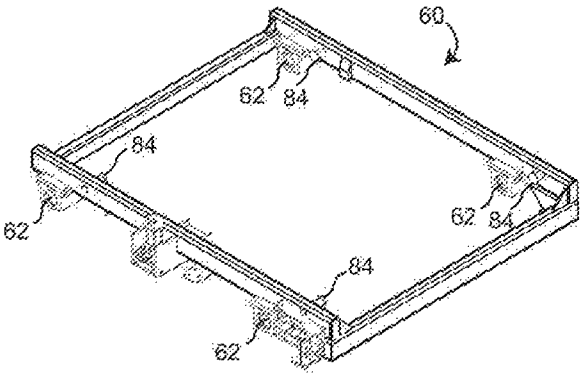
FIGS. 34-40 are schematic diagrams of a drilling tool carriage for the drilling tool changer apparatus, according to an exemplary embodiment.
Figure 40:
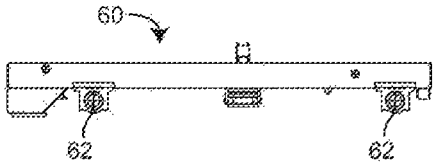
Figure 36:
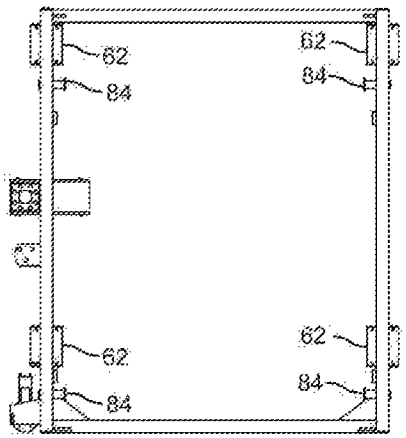
Figure 37:
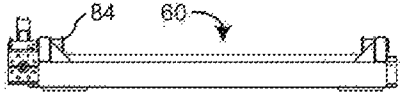
Figure 38:
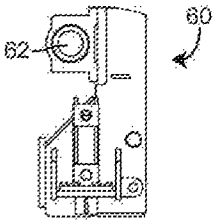
Figure 34:
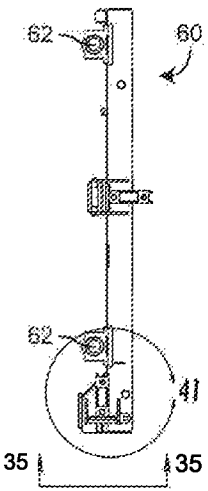
Figure 35:
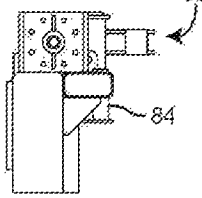
Figure 41:
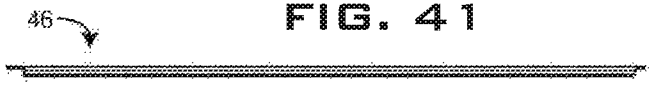
FIGS. 41-47 are schematic diagrams of the access panel for the drilling tool changer apparatus, according to an exemplary embodiment.
Figure 42:
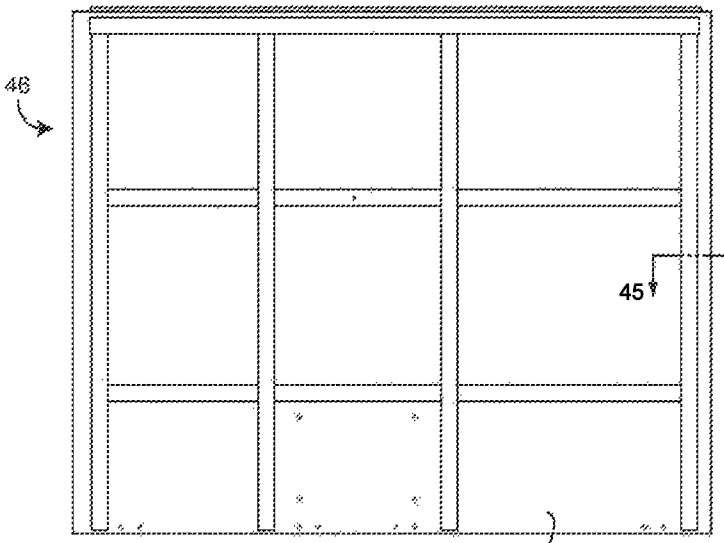
Figure 44:
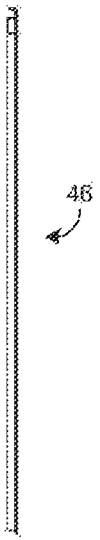
Figure 43:
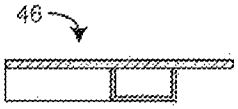
Figure 45:
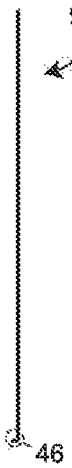
Figure 47:
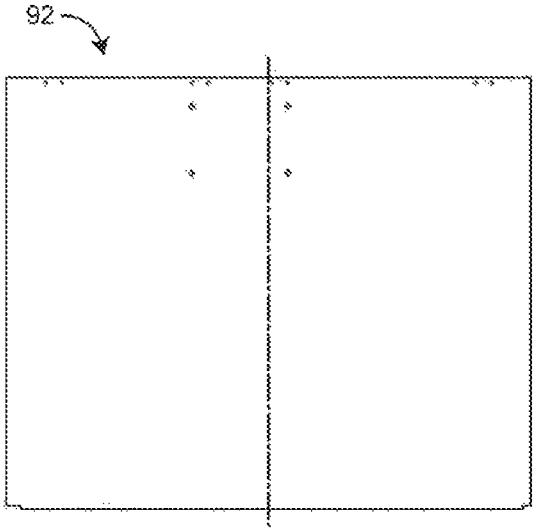
Figure 46:
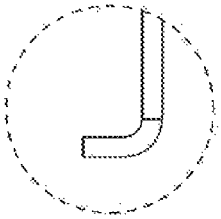
Figure 50:
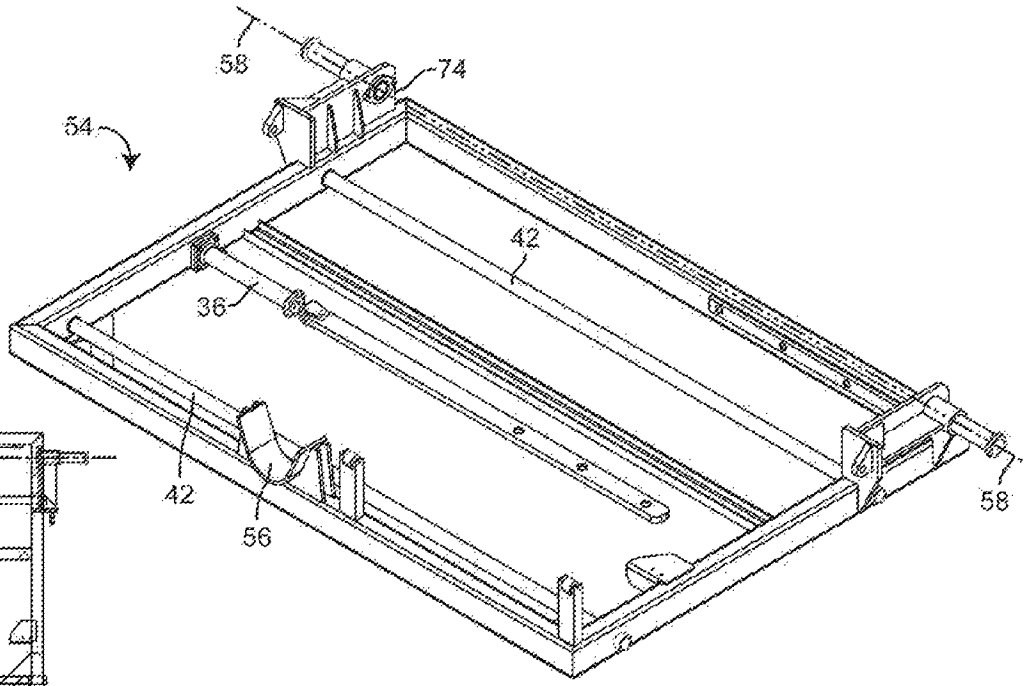
FIGS. 48-50 are schematic diagrams of a drilling tool pivot frame for the drilling tool changer apparatus, according to an exemplary embodiment.
Figure 48:
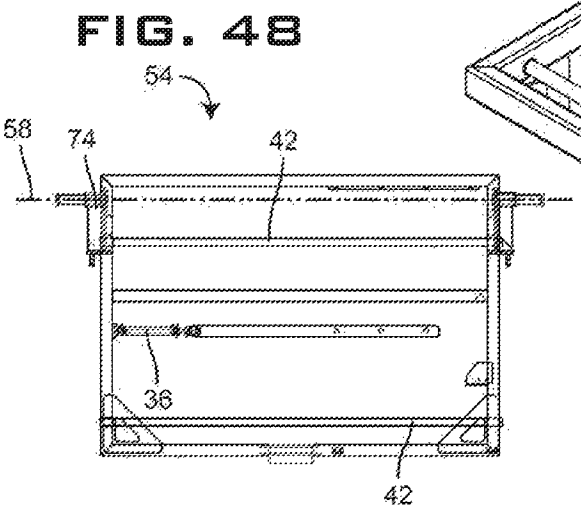
Figure 49:
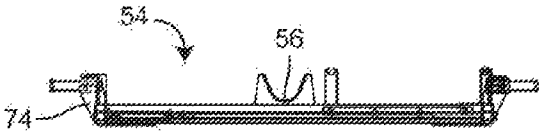

The drilling tool changer apparatus 10 is shown in the Figures to include a drilling tool storage device 18 (e.g. cartridge, compartment, magazine, etc.) (shown in FIG. 6 and shown more particularly in FIG. 20) having a laterally translatable carriage 60 with a cassette 20 containing storage receptacles 22 (e.g. "slots," etc.) (shown particularly in FIG. 25) for storing a plurality of drilling tools 12 (shown by way of example in the Figures as four (4) drilling tools) in a substantially linear array that has a low profile that is intended to fit conveniently beneath (or otherwise in cooperation with) a platform 24 of the drilling rig 100 adjacent to a drill tower 26 (shown in FIG. 6). The cassette 20 is removably replaceable from the carriage 60 so that new cassettes with new or other types of drilling tools 12 may be readily installed to suit a particular application or drilling plan. The cassette 20 accommodates combined storage of various rotary drilling bits and hammer drilling bits of different sizes in a single device so that all the tools 12 can be managed more efficiently and with greater service access (e.g. from the ground with a service truck winch, etc.). The linearly configured drilling tool storage device 18 is also intended to provide certain other advantages over other types of drill bit storage devices, such as (for example) rotary carousels.

Figure 2:
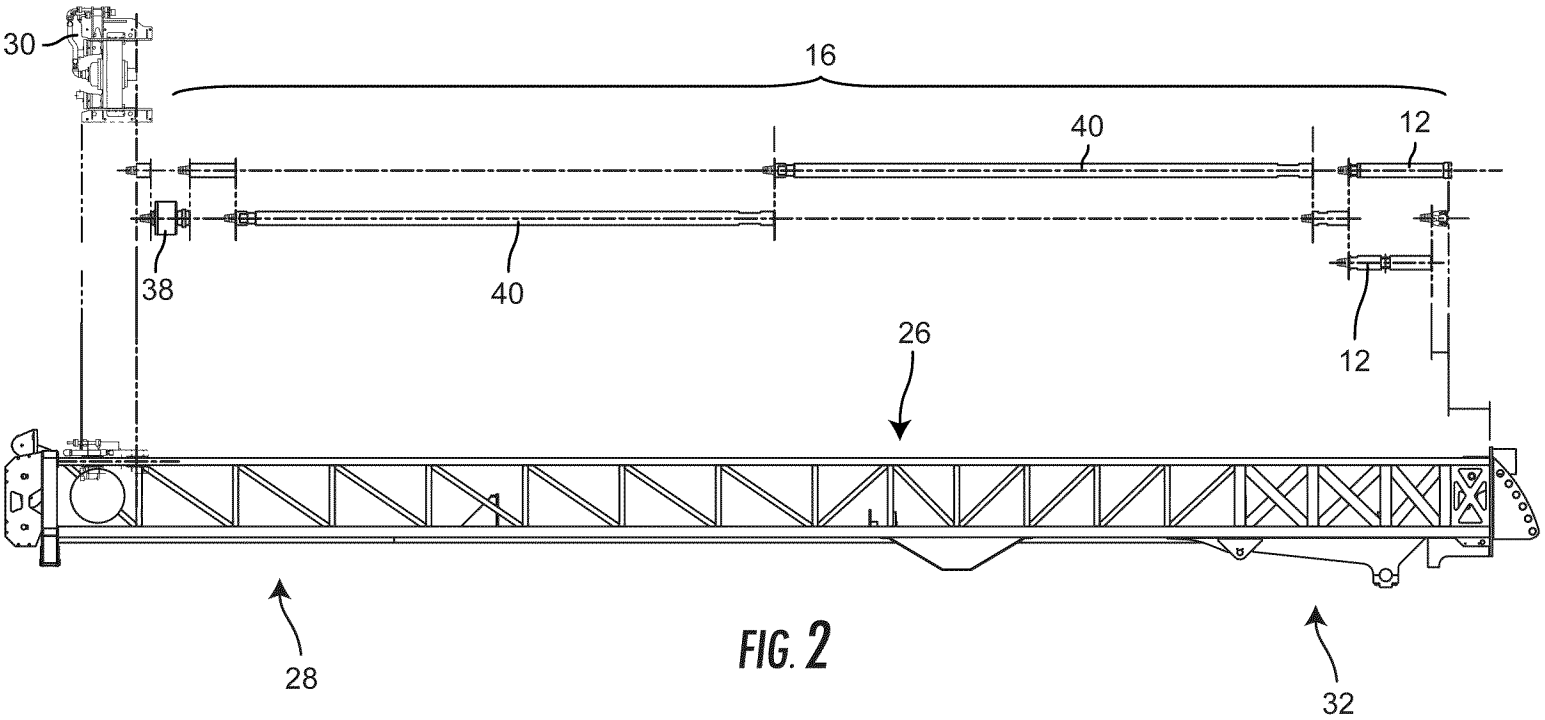
FIG. 2 is a schematic image of components of the drilling rig of FIG. 1, including a drill tower, drill rods and drilling tools, according to an exemplary embodiment.
Figure 4:
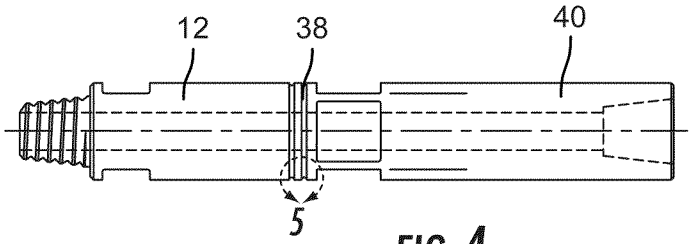
FIGS. 3-5 are schematic images of a drilling tool for use with the drilling rig of FIG. 1, according to an exemplary embodiment.
Figure 5:
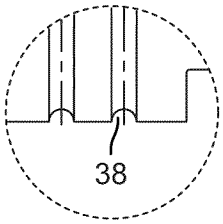
Figure 3:
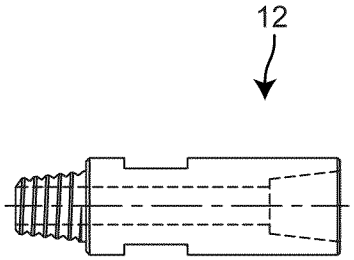

Referring to FIG. 2, the drill tower 26 includes an upper end 28 configured to support a drill motor 30 and related components, and a lower end 32 configured to be pivotally supported on the platform 24 for rotation between a substantially vertical orientation (i.e. a drilling orientation) and a change-out orientation (e.g. disposed at an angle within a range of approximately 30-70. degrees, and more particularly at an angle of approximately 54. degrees from a drill hole axis (the "change-out angle")), which may be substantially vertical, or may be disposed in a non-vertical orientation depending on a particular application. According to another embodiment, other change-out angles may be used as may be determined to be preferable. Movement of the drill tower 26 between the drilling orientation (shown in FIG. 4) and the change-out orientation (shown in FIG. 9) is facilitated by one or more actuators 34, shown by way of example as hydraulic cylinders in FIG. 1 that are provided with a supply of pressurized hydraulic fluid from a hydraulic system (not shown) associated with the drilling rig 100. Operation of the actuators 34 for positioning the drill tower 26 may be accomplished using suitable valves and instruments that operate in response to signals or other instructions received from the drilling control device 14.

Referring to FIGS. 2-5, certain other components of the drilling rig 100, including a drill motor 30, shock absorbing grooves 38, drill extenders 40 (e.g. drill pipes, rods, etc.) and drilling tools 12 (e.g. drill bits such as rotary tricone drill bits of various types and sizes, hammering tools such as DHH hammers, etc.) are shown according to an exemplary embodiment.

Referring to FIGS. 6-50, the drilling tool changer apparatus 10 having a deployable, linearly-configured drilling tool storage device 18 for use with a drilling rig 100 (or the like) is shown according to an exemplary embodiment. The drilling tool changer apparatus 10 as illustrated in the exemplary embodiments includes the drill tower 26 with actuators 34 for pivotally rotating the drill tower 26 between the drilling orientation and the change-out orientation, and the linearly-configured drilling tool storage device 18 that is pivotally movable about a forward hinge axis 58 (shown in FIG. 20) from a stowed position (shown in FIG. 9) during drilling operations to a deployed position (shown in FIG. 12) during drilling tool change-out. In the deployed position, the drilling tool storage device 18 is oriented at approximately the same change-out angle as the drill tower 26 and is aligned in a substantially co-planar manner with the drill tower 26 (e.g. with the forward hinge axis 58 perpendicularly bisecting the drill pipe axis when in the change-out orientation), so that the drill pipe 40 and the drilling tool 12 (e.g. the 'used' drilling tool to be replaced, and the 'new' or 'replacement' drilling tool to be installed) are substantially coaxial with one another when the applicable storage receptacles 22 in the cassette 20 are indexed into coaxial alignment with the drill pipe 40.

Referring further to FIGS. 6-50, the drilling tool storage device 18 is constructed as a substantially rectangular frame arrangement having suitable cross members or rails 42 (shown in FIG. 9) and a translatable carriage 60 (shown in FIG. 20) having supports for supporting (i.e. holding, cradling, etc.) the drilling tools 12. Each storage receptacle 22 is shown to include anti-rotation elements, shown as shoulders 44 (see FIG. 26) that fit with slots or lands on the drilling tools 12 to prevent rotation of the tools while in the storage receptacles 22 (e.g. to resist the torque applied by the drill pipe 40 during detachment [e.g. separation, disengagement, etc.] of the used drilling tool 12 and attachment [e.g. connection, engagement, etc.] of the replacement drilling tool 12). The storage device 18 is also shown to include a drill pipe support in the form of a cradle 56 (e.g. shown as a half-cylindrical section) (shown in FIG. 9 and more particularly in FIG. 49) that is configured to support and facilitate alignment of the drill pipe 40 with the tool 12 and storage receptacle 22 during the tool change-out operation. The carriage 60 is laterally translatable within the storage device 18 so that the storage receptacles 22 for each of the drilling tools 12 may be indexed into alignment with the drill pipe 40 during change-out operations. The multiple storage receptacles 22 within the cassette 20 are intended to permit establishing a drilling tool change-out strategy adapted to suit a particular job site and/or drilling condition. For example, one or more locations may be intentionally empty and intended for receiving a used drilling tool 12 to be replaced. Other storage receptacles 22 may be loaded with a drill bit (or various drill bits having the same or different cutting characteristics and sequentially arranged in a sequential manner intended to best-suit the drilling operation). Other storage receptacles may be loaded with hammering tool(s) or other suitable tools for use in the drilling operation.

Referring further to FIGS. 6-50, translation of the carriage 60 within the storage device 18 is accomplished using a suitable actuator 36 (e.g. pneumatic cylinder, hydraulic cylinder, linear actuator, chain and sprocket, etc.) (shown in FIG. 9) that is actuated using suitable valves, motors or the like that are controlled by signals or other instructions received from the drilling control device 14. The storage device 18 is shown to be disposed within the platform 24 at a location proximate the drill tower 26 such that the drill pipe 40 aligns near an approximate center of the storage device 18. In this manner, the carriage 60 can be indexed laterally from one side to the other to position the desired storage receptacle 22 into coaxial alignment with the drill pipe 40. The location of the storage device 18 is also positioned so that when the drill tower 26 and the storage device 18 are moved to the change-out orientation, there is sufficient clearance with the drill tower 26 and the drill pipe 40 to prevent interference or damage among the components. Movement of the storage device 18 about the forward hinge axis 58 between the stowed position and the deployed or change-out position is accomplished using suitable actuators 68 (e.g. pneumatic cylinders, hydraulic cylinders, linear actuators, etc.) (shown in FIG. 22) that are actuated using suitable valves, motors or the like that are controlled by signals or other instructions received from the drilling control device 14. According to alternative embodiments, the weight of the storage device 18 may be at least partially offset using suitable biasing devices (e.g. springs, counterweights, etc.), and all such variations are intended to be within the scope of this disclosure.

Referring further to FIGS. 6-50, the storage device 18 is also shown to include one or more access or cover panels 46 (shown in FIG. 6), which when in the stowed position provide a substantially uniform work surface on the platform 24 and protect the storage device 18 from contaminants and other possible sources of damage, etc. In an exemplary embodiment, each panel 46 includes a plate 92 (shown in FIGS. 45-47) for providing the flat surface of the panel 46. The panels 46 may be deployable between an open position (shown in FIG. 9) and a closed position (shown in FIG. 6) using a suitable actuator 70 (e.g. pneumatic cylinder, hydraulic cylinder, linear actuator, second actuator, etc.) (shown in FIG. 9) as needed to permit the drilling tools 12 to be attached and detached from the drill pipe 40. According to the illustrated embodiment the storage device 18 raises and lowers the drilling tool 12 (supported in the applicable storage receptacle 22) into coaxial alignment with the drill pipe 40 and the drill pipe 40 extends, retracts and rotates (both clockwise and anti-clockwise) as required to detach a used drilling tool 12 and to attach a new or replacement drilling tool 12, such that the drilling tool 12 enters and releases from a 'top' of the cassette 20. However, according to alternative embodiments, the storage device 18 may support the drilling tools 12 for entry and release from the rearward end of the cassette 20 (i.e. coaxially with the drill pipe 40 and storage receptacles 22) using suitable devices such as releasable grippers, etc. All such variations are intended to be within the scope of this disclosure.

Figure 6:
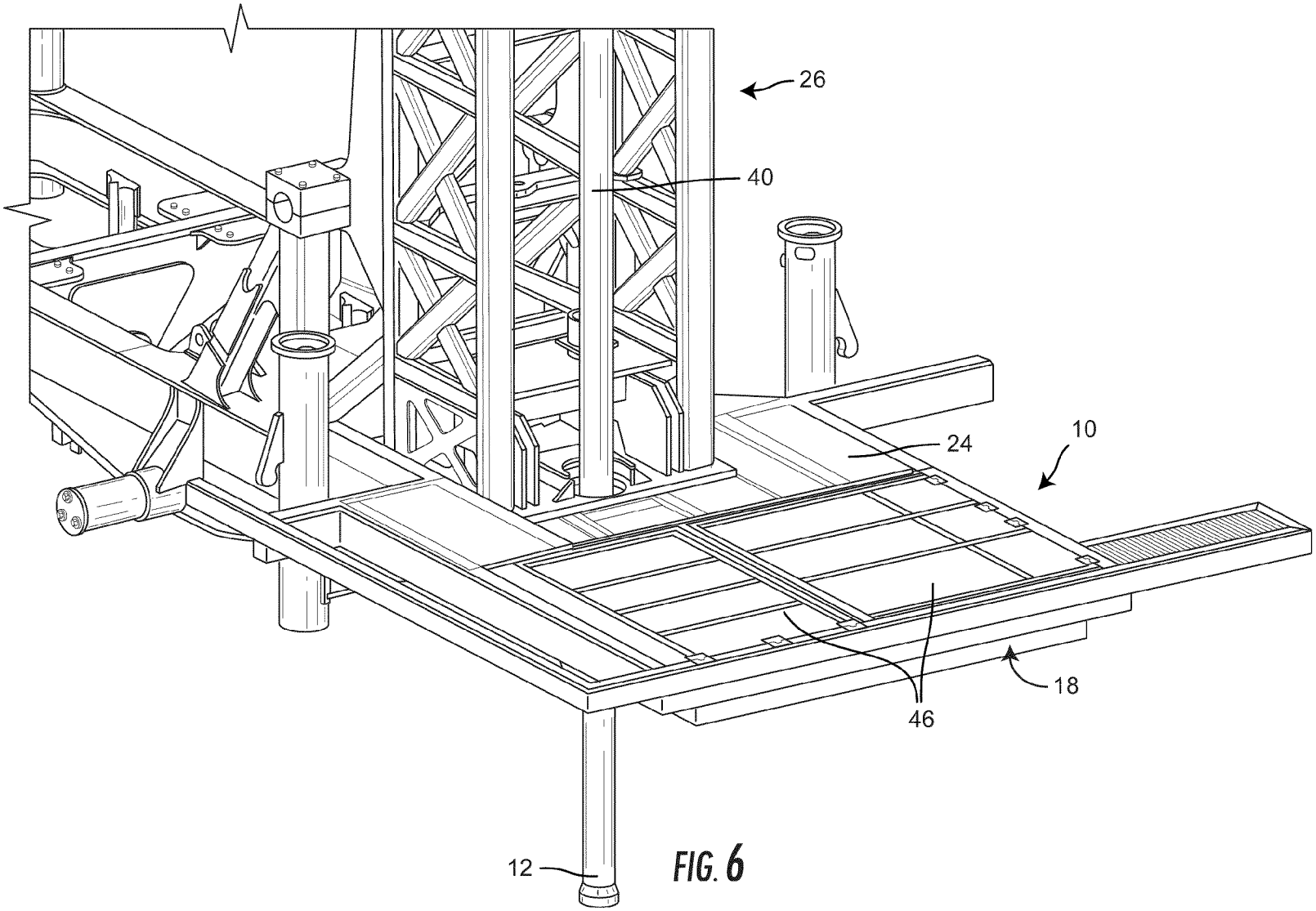
FIG. 6 is an image of a portion of the drilling rig of FIG. 1, including a drilling tool changer apparatus with the drilling tool in a drilling position, according to an exemplary embodiment.

Referring now to FIG. 6, the drilling tool changer apparatus 10 is shown with the drill tower 26 in the drilling orientation, the drill pipe(s) 40 and drilling tool 12 in a drilling position/location and the storage device 18 in the stowed position to support the drilling operation, according to an exemplary embodiment. The drill string 16 may include any suitable number of drill pipes 40, which may be added and removed from the drill string 16 using any suitable drill rod changing apparatus or mechanism.

Figure 7:
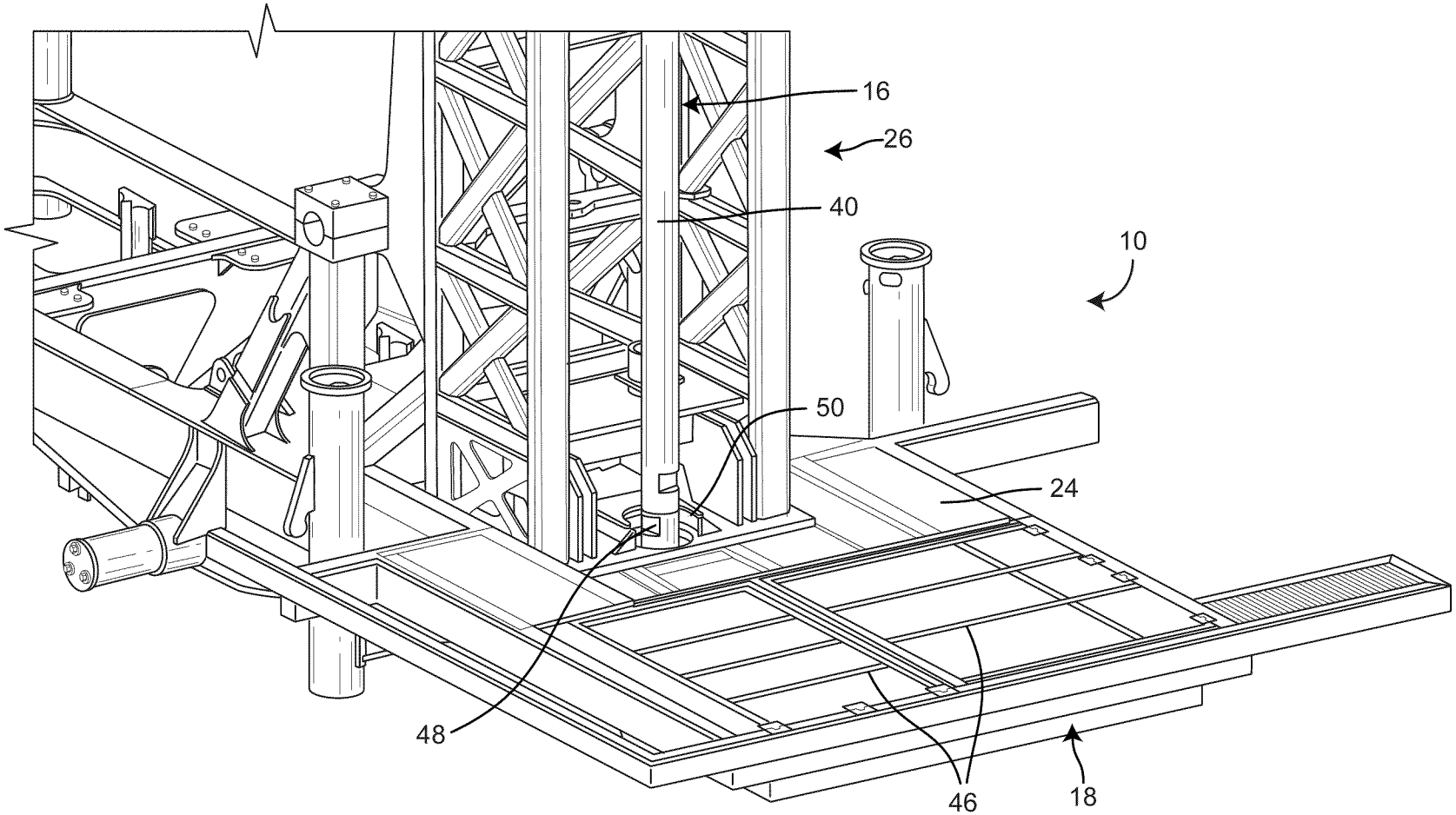
FIG. 7 is an image of a portion of the drilling rig of FIG. 1, including the drilling tool changer apparatus with the drilling tool withdrawn to a break-out position, and the drilling tool is broken-out at this position, according to an exemplary embodiment.

Referring to now to FIG. 7 the drilling tool changer apparatus 10 is shown with the drilling tool 12 withdrawn (e.g. moved upwardly from the drill hole, etc.) from the drilling position to a break-out position in order to initiate a drilling tool change-out (e.g. in response to a signal or other instruction from the drilling control device 14), according to an exemplary embodiment. At the break-out position, the lands or flats 48 on the drilling tool 12 are substantially in axial registry with a hydraulically operated break out device 50 (e.g. wrench, etc.) disposed proximate the drill tower base and platform 24. The hydraulically operated break out wrench 50 engages the drilling tool 12 and the drill motor 30 rotates the drill pipe 40 to at least partially loosen the drilling tool 12 from the lower end of the lowermost drill pipe 40 (according to FIG. 7) in the drill string 16, so that the drilling tool 12 is prepared for change-out.

Figure 8:
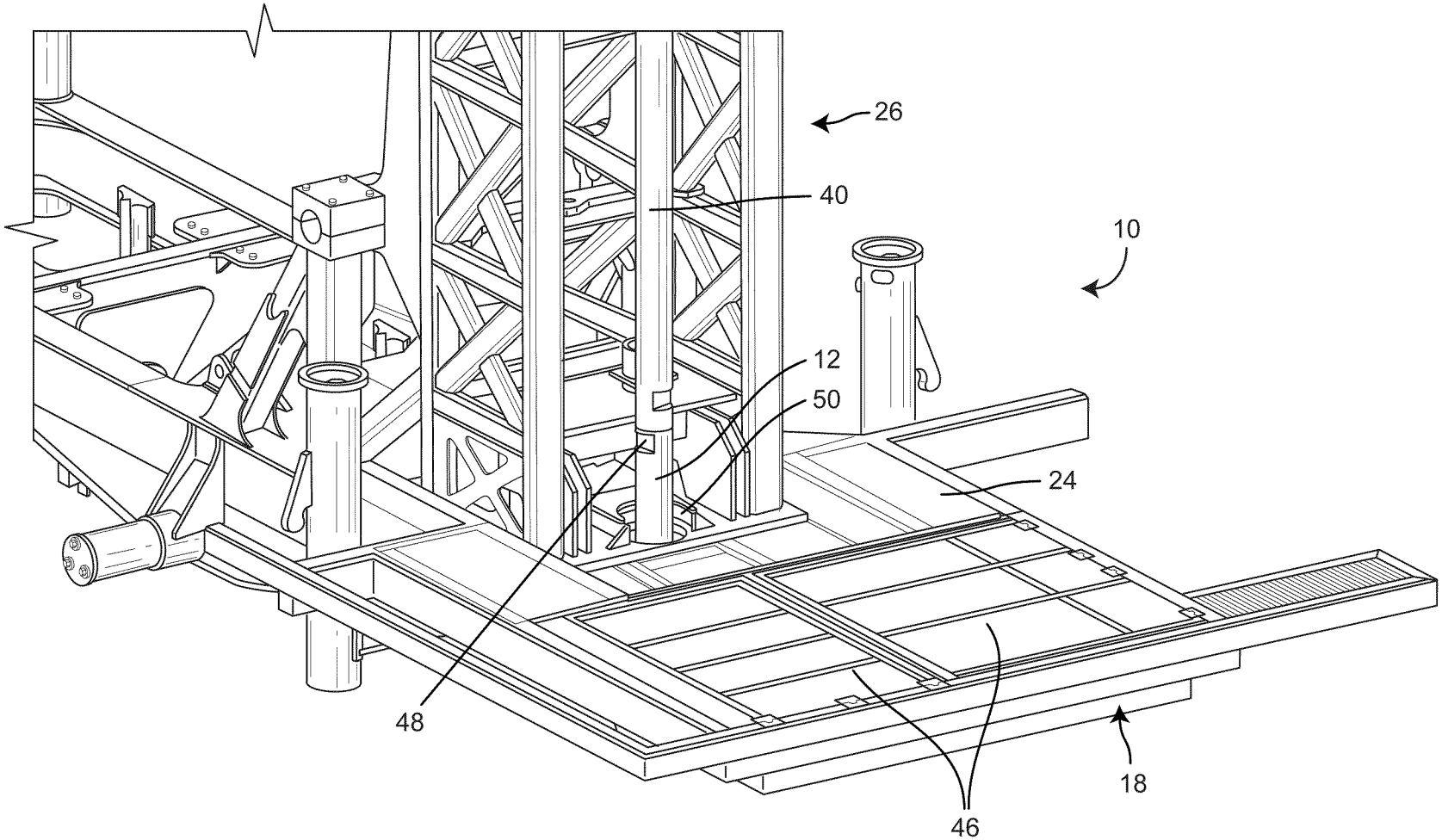
FIG. 8 is an image of a portion of the drilling rig of FIG. 1, including the drilling tool changer apparatus with the drilling tool further withdrawn to a retracted position that is into a dust hood, according to an exemplary embodiment.

Referring now to FIG. 8, the drilling tool changer apparatus 10 is shown with the drilling tool 12 further withdrawn to a retracted position, according to an exemplary embodiment. With the drilling tool 12 in a retracted position, the drilling tool 12 is disposed within a dust hood 52 (shown in FIG. 10) proximate the lower end of the drill tower 26, such that the drill tower 26 may be pivoted from its drilling orientation to the change-out orientation with the drilling tool 12 sufficiently retracted to prevent interference with the platform components (e.g. platform 24).

Figure 9:
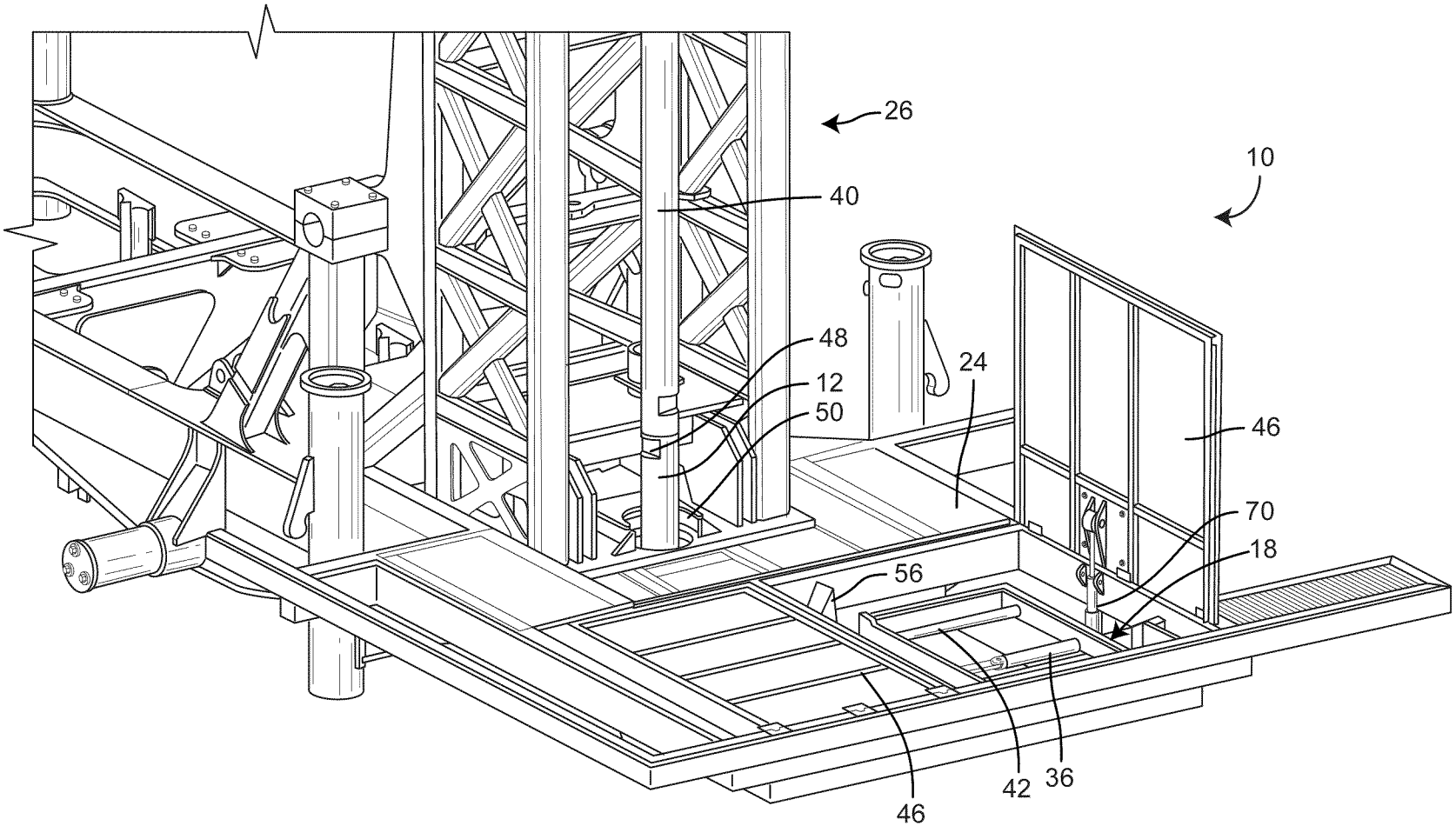
FIG. 9 is an image of a portion of the drilling rig of FIG. 1, including the drilling tool changer apparatus with the drilling tool in the retracted position and an access panel for a drilling tool storage device raised from a closed position to an open position, according to an exemplary embodiment.

Referring now to FIG. 9, the access panel 46 (e.g., cover panel, cassette access panel, etc.) for the drilling tool storage device 18 is shown raised from a closed position to an open position to facilitate deployment of the drilling tool storage device 18, according to an exemplary embodiment.

Figure 10:
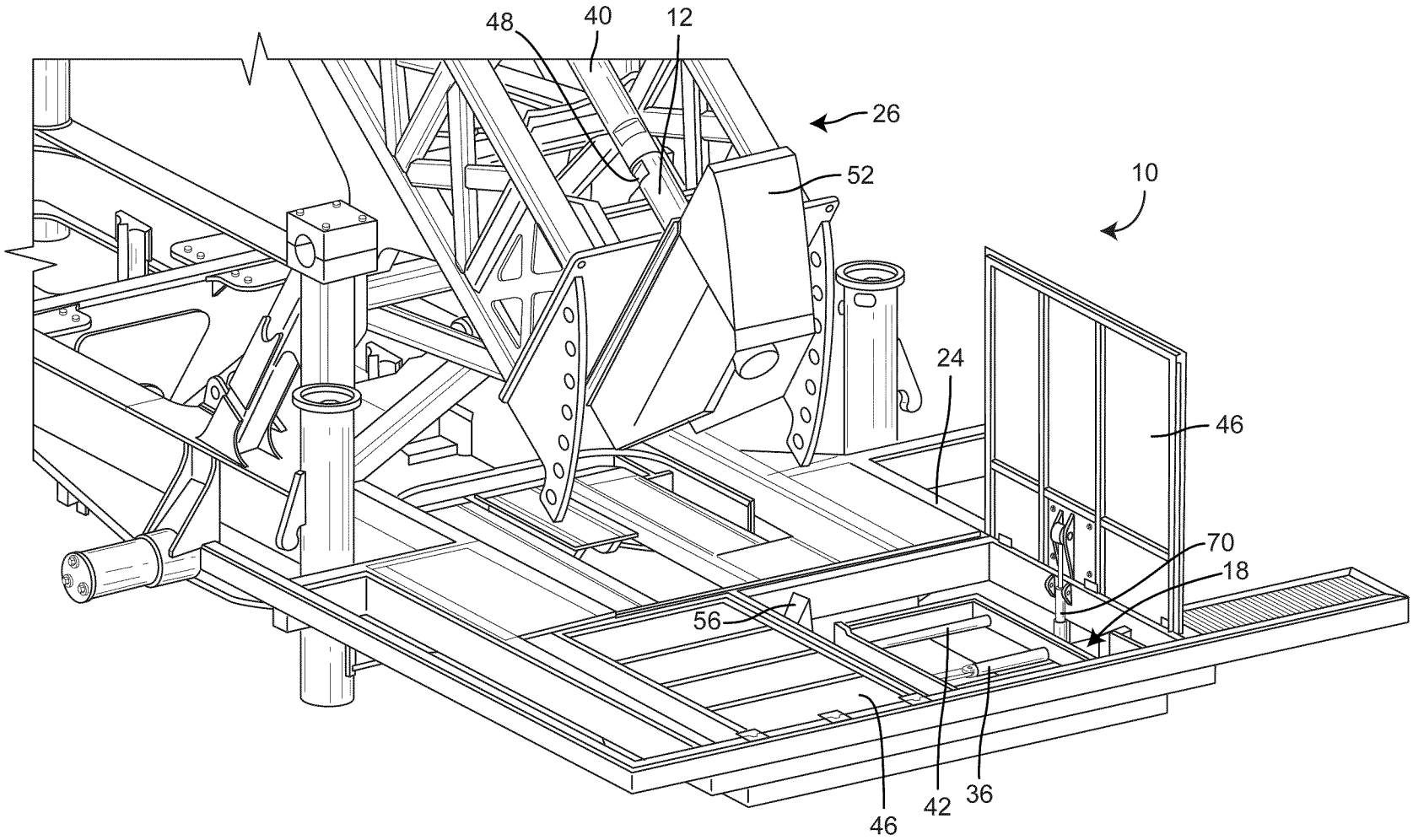
FIG. 10 is an image of a portion of the drilling rig of FIG. 1, including the drilling tool changer apparatus with the drilling tool in the retracted position and the drill tower rotated from a drilling orientation to a change-out orientation (e.g. at a change-out angle), according to an exemplary embodiment.

Referring now to FIG. 10, the drill tower 26 is shown rotated from the drilling orientation to the change-out orientation (e.g. at a change-out angle of approximately 54 degrees), according to an exemplary embodiment. The drill tower 26 (or mast) may be moved using suitable actuators 34 (e.g. hydraulic, etc.) that operate in response to appropriate control signals received from the drilling control device 14.

Figure 11:
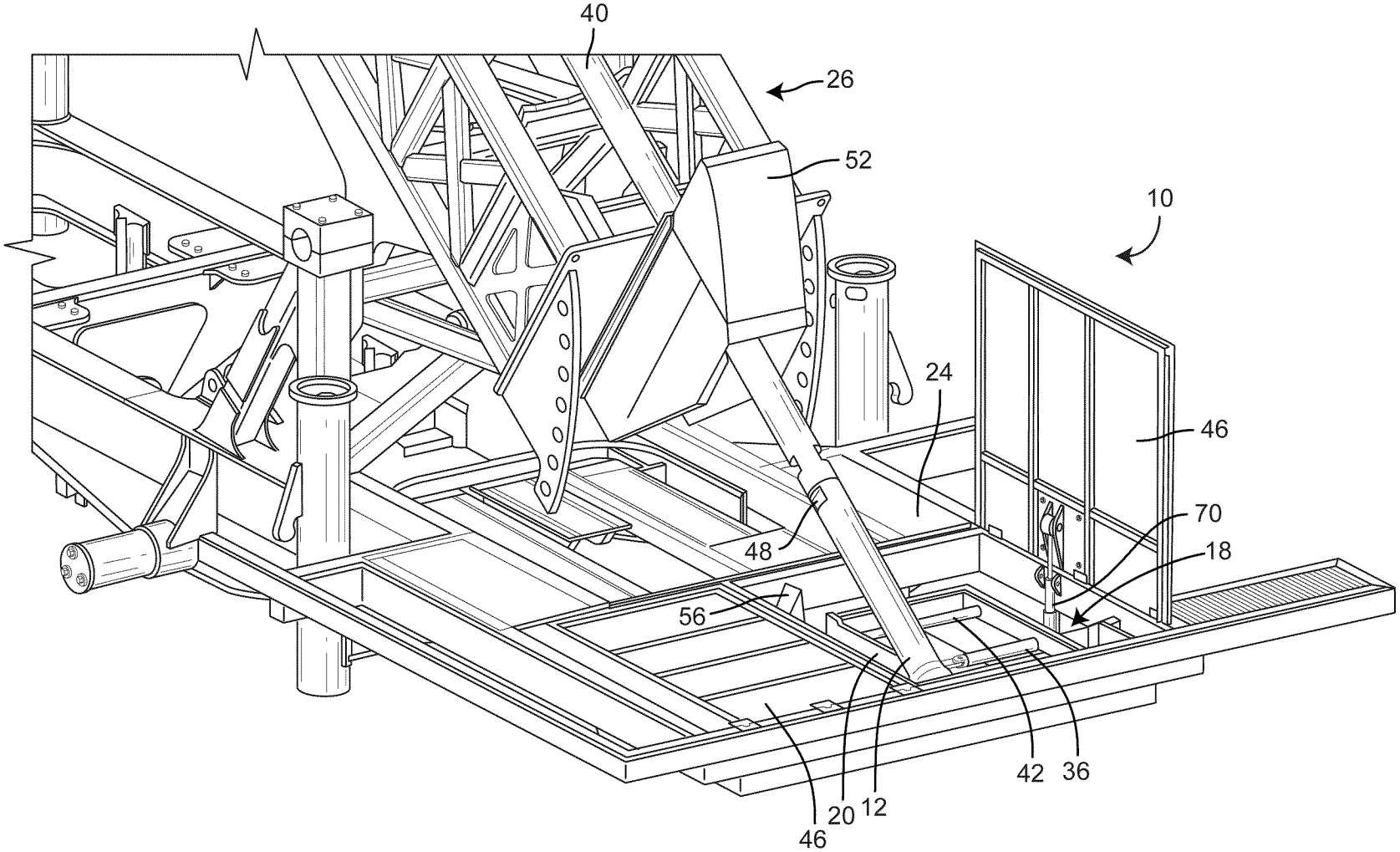
FIG. 11 is an image of a portion of the drilling rig of FIG. 1, including the drilling tool changer apparatus with the drill tower rotated to the change-out angle and the drilling tool extended to a change-out position, according to an exemplary embodiment.

Referring now to FIG. 11, the drilling tool 12 is shown extended to a change-out position, according to an exemplary embodiment. In the change-out position, with the drill tower 26 in the change-out orientation, the used drilling tool 12 is extended until a lower end of the used drilling tool 12 is disposed proximate a forward edge of the storage device 18, in preparation to be received by the cassette 20. The carriage 60 within the storage device 18 has been laterally indexed to an open location (e.g. an empty storage receptacle 22) positioned beneath the used drilling tool 12, in response to an appropriate signal from the drilling control device 14.

Figure 12:
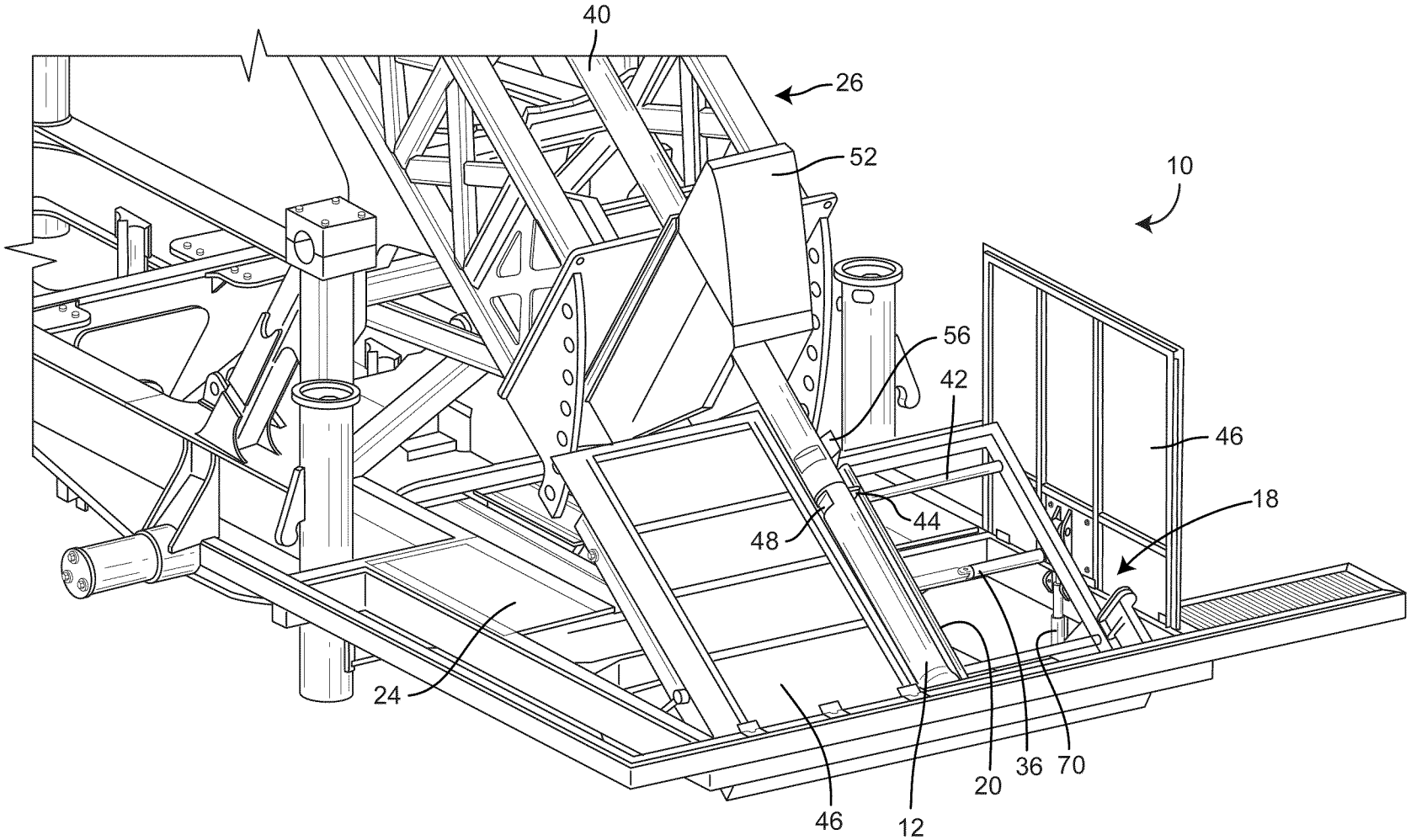
FIG. 12 is an image of a portion of the drilling rig of FIG. 1, including the drilling tool changer apparatus with the drill tower at the change-out angle and the drilling tool at the change-out position and the drilling tool storage device raised from a stowed position to a deployed position (e.g. at the change-out angle) to receive the drilling tool in a storage receptacle within the cassette, according to an exemplary embodiment.

Referring now to FIG. 12, the drilling tool storage device 18 is pivotally raised about the forward edge hinge connection (i.e., forward hinge axis 58) from the stowed position to the deployed position (e.g. at the change-out angle) to receive (e.g. cradle, etc.) the drilling tool 12 into the open storage receptacle 22 within the cassette 20 of the storage device 18, according to an exemplary embodiment. When cradled in the storage receptacle 22, the shoulders 44 within the receptacle 22 align with flats 48 or lands on the drilling tool 12 to substantially restrict rotation of the drilling tool 12.

Figure 13:
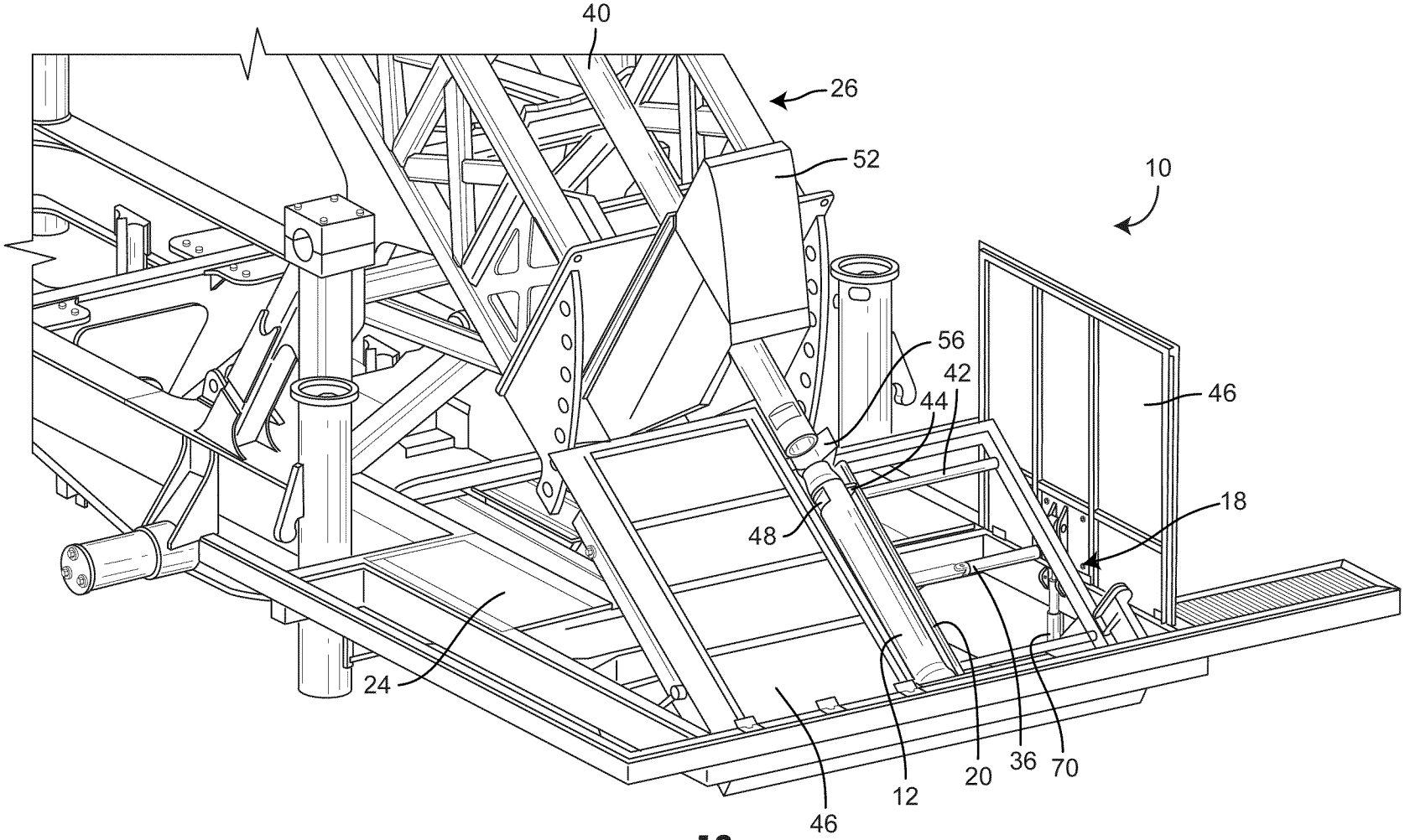
FIG. 13 is an image of a portion of the drilling rig of FIG. 1, including the drilling tool changer apparatus with the drilling tool in the storage receptacle of the cassette and detached from the drill pipe, with the drill pipe withdrawn to a standby position, according to an exemplary embodiment.

Referring now to FIG. 13, with the drilling tool 12 cradled and non-rotatably fixed in the storage receptacle 22 of the cassette 20, the drill pipe 40 is rotated to disengage (or detach) the drilling tool 12 from the drill pipe 40, and the drill pipe 40 is withdrawn to a standby position, according to an exemplary embodiment, in preparation for coupling (e.g. attaching, installing, connecting, etc.) to the replacement drilling tool 12.

Figure 14:
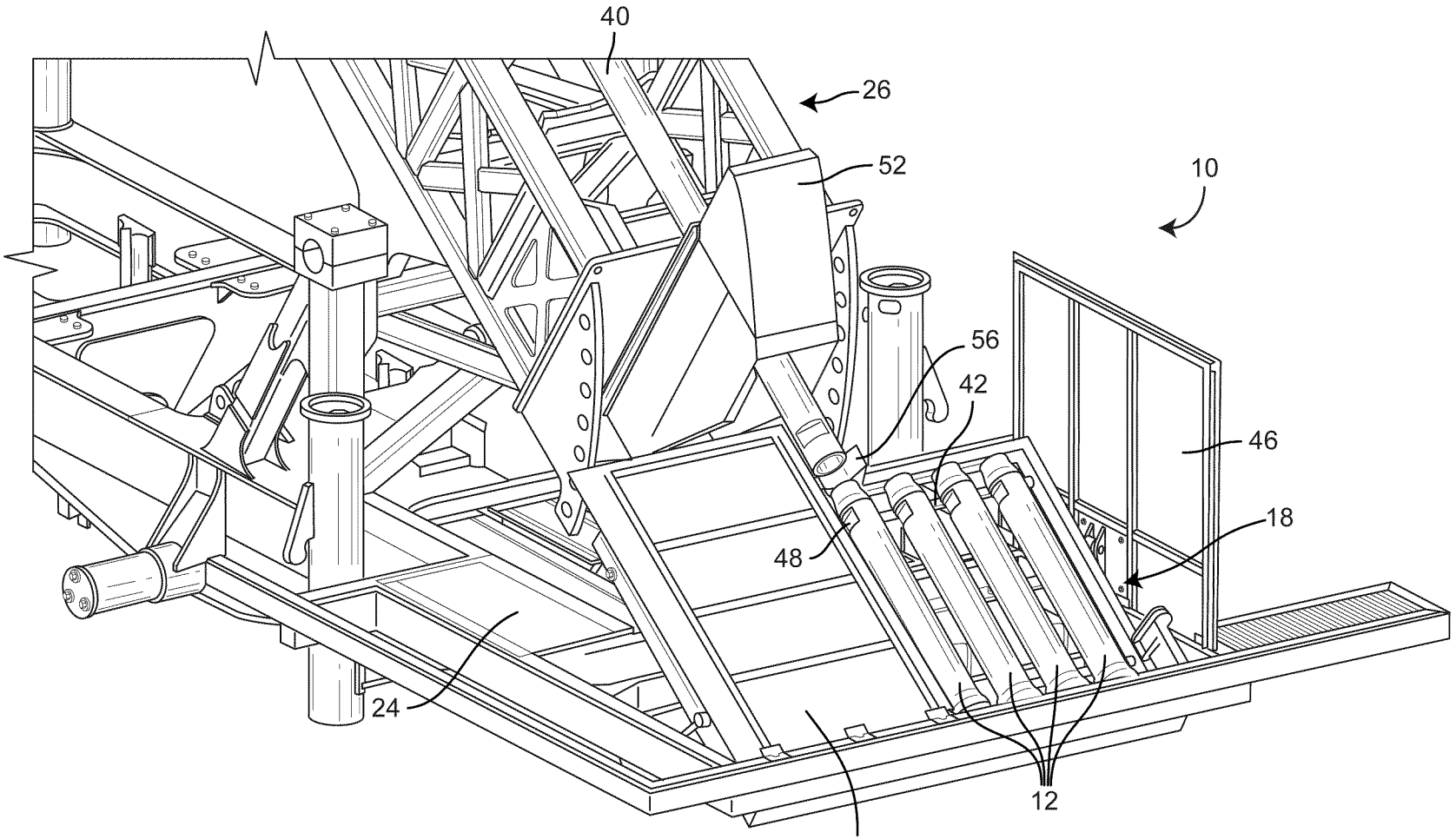
FIG. 14 is an image of a portion of the drilling rig of FIG. 1, including the drilling tool changer apparatus with the drilling tool in the storage receptacle of the cassette, and the cassette indexed to a desired position to present a replacement drilling tool for attachment to the drill pipe, according to an exemplary embodiment.

Referring to FIG. 14, the carriage 60 with the cassette 20 is laterally indexed to a new position corresponding to the desired replacement drilling tool 12 for alignment with, and attachment to, the drill pipe 40, according to an exemplary embodiment. The replacement drilling tool 12 may be any suitable tool for use in the drilling operation.

Figure 15:
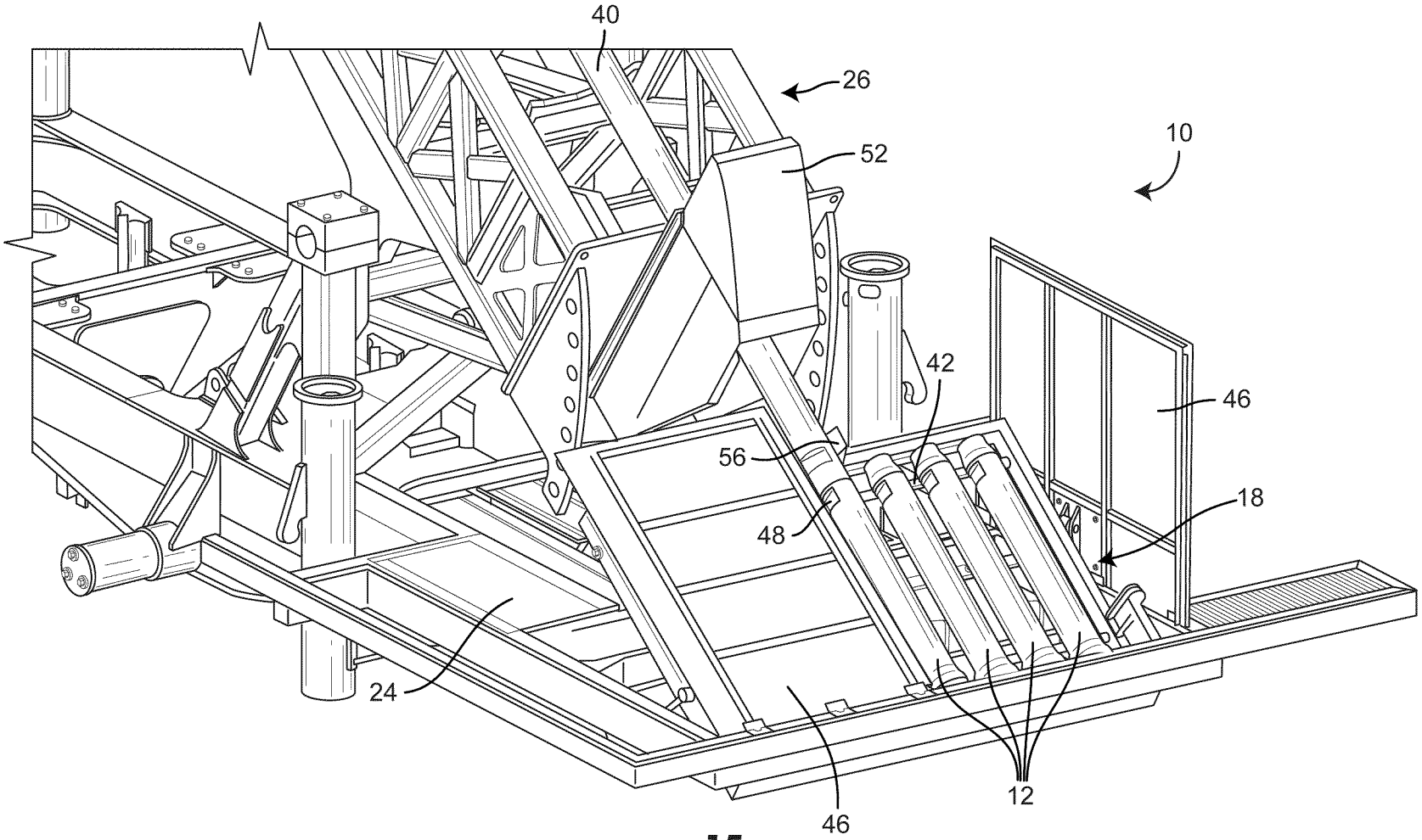
FIG. 15 is an image of a portion of the drilling rig of FIG. 1, including the drilling tool changer apparatus with the cassette indexed to the desired position to present the replacement drilling tool and the drill pipe extended and rotated into engagement with the replacement drilling tool, according to an exemplary embodiment.

Referring now to FIG. 15, the drill pipe 40 is extended and rotated into engagement with the replacement drilling tool 12, according to an exemplary embodiment.

Figure 16:
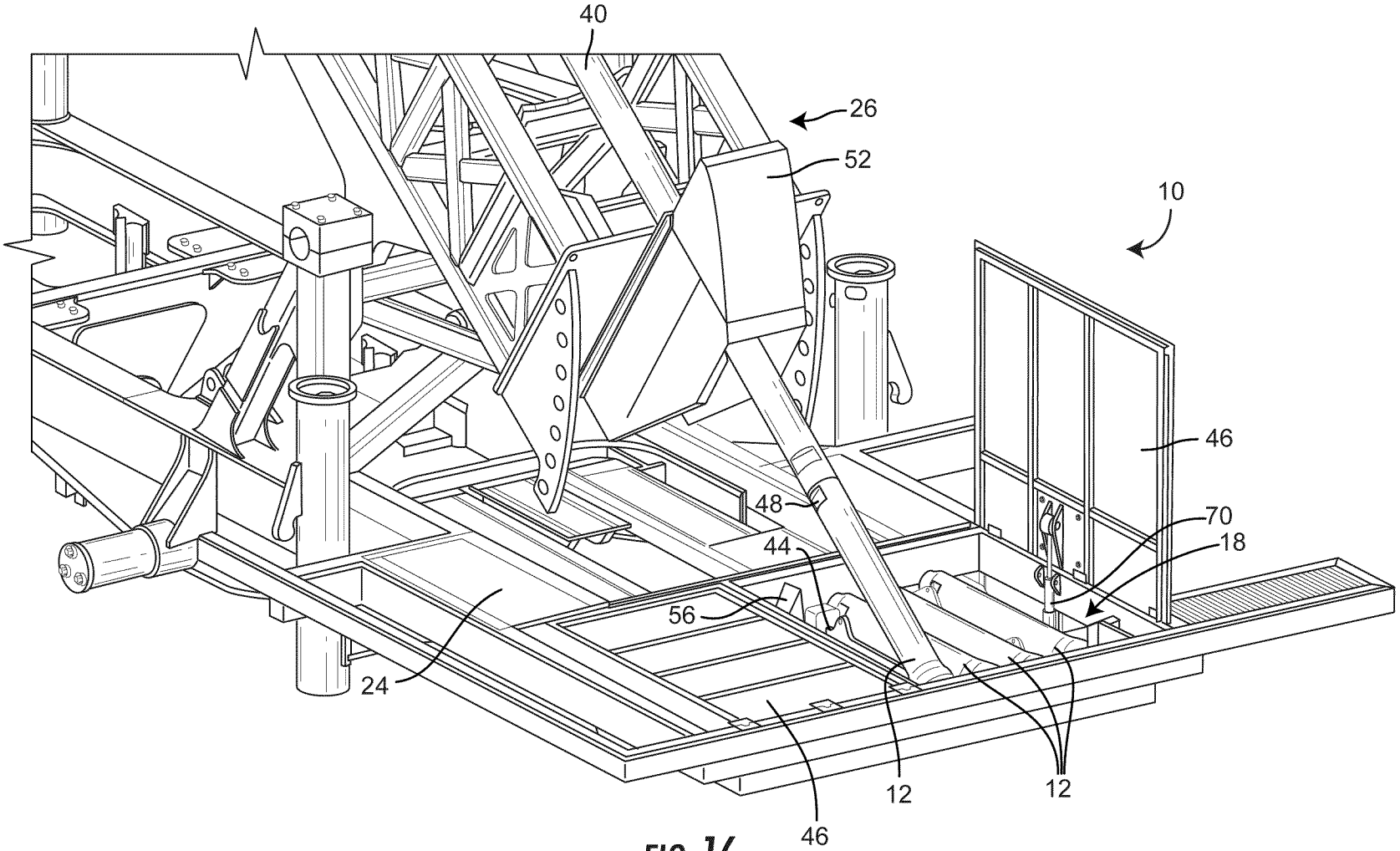
FIG. 16 is an image of a portion of the drilling rig of FIG. 1, including the drilling tool changer apparatus with the drilling tool storage device lowered from the deployed position to the stowed position and the replacement drilling tool engaged on the drill pipe, according to an exemplary embodiment.

Referring now to FIG. 16, the storage device 18 releases (e.g. disengages) from the drilling tool 12 by pivotally lowering from the deployed position to the stowed position, with the replacement drilling tool 12 remaining engaged on the drill pipe 40, according to an exemplary embodiment, in order to begin restoring the drill tool changer apparatus 10 to the drilling mode of operation.

Figure 17:
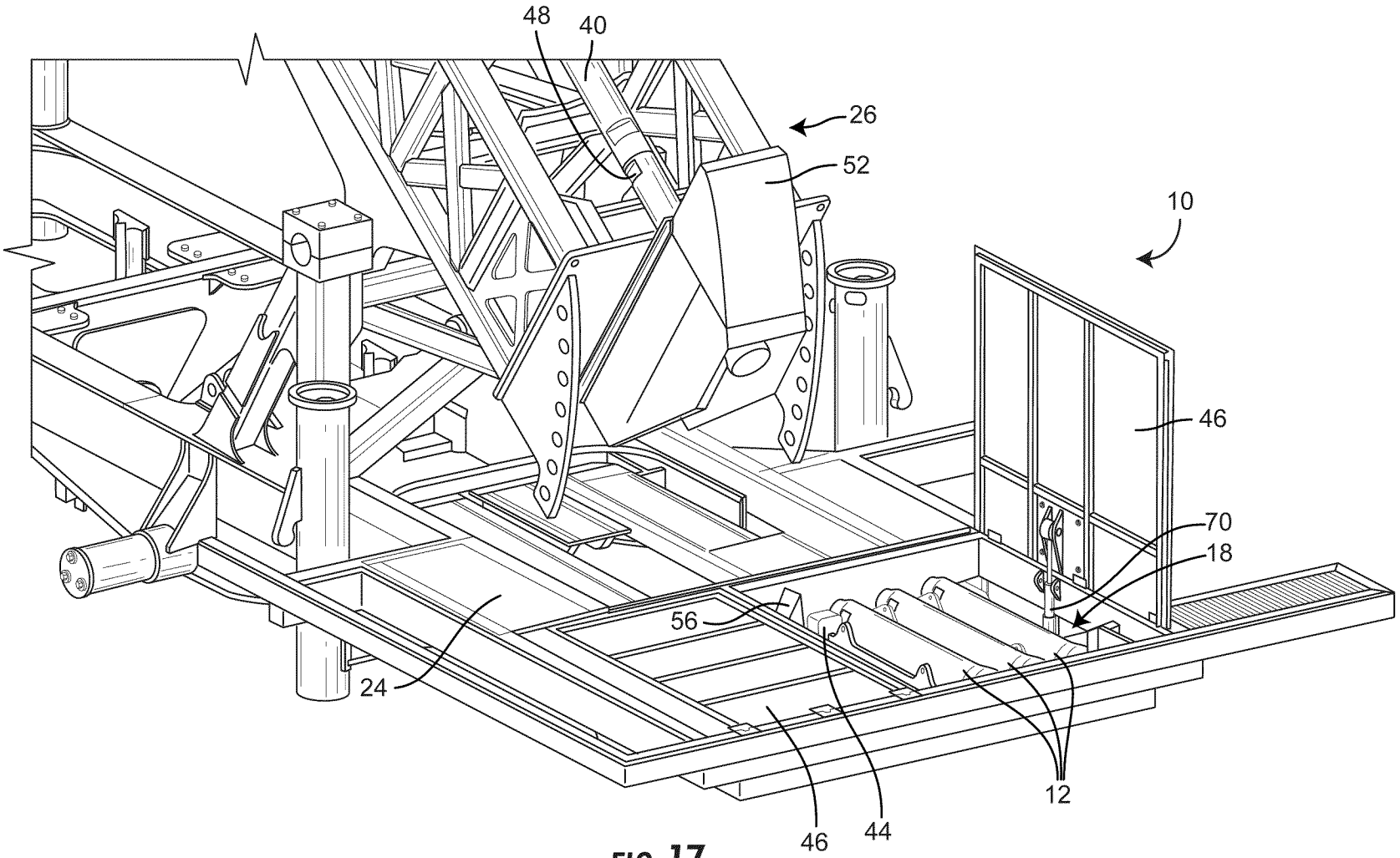
FIG. 17 is an image of a portion of the drilling rig of FIG. 1, including the drilling tool changer apparatus with the drilling tool storage device in the stowed position and the replacement drilling tool and drill pipe withdrawn to the refracted position in the dust hood, according to an exemplary embodiment.
Figure 18:
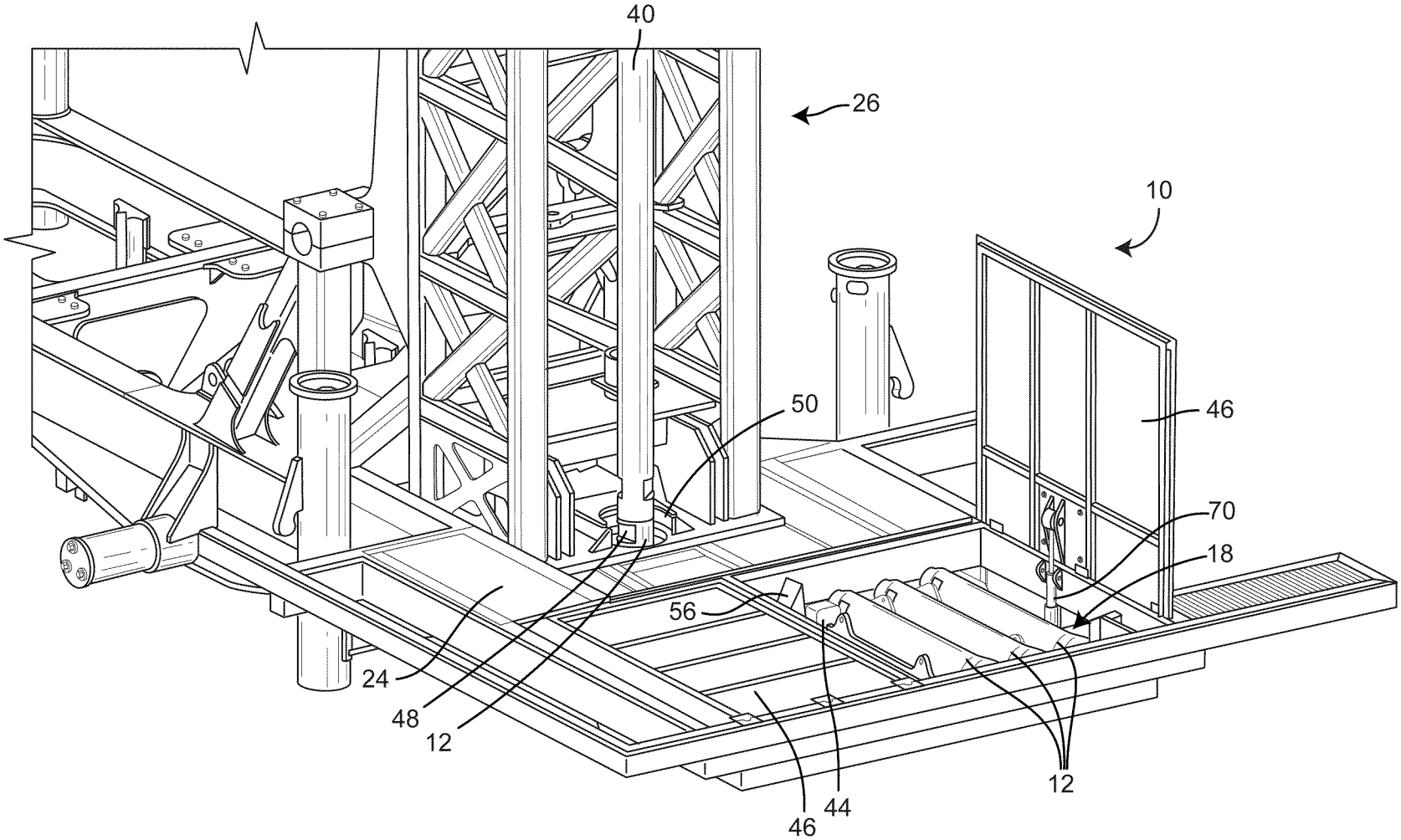
FIG. 18 is an image of a portion of the drilling rig of FIG. 1, including the drilling tool changer apparatus with the drilling tool storage device in the stowed position and the drill tower rotated from the change-out orientation to the drilling orientation, according to an exemplary embodiment.

Referring now to FIG. 17, the drill pipe 40 with the replacement drilling tool 12 installed thereon are withdrawn to the retracted position, according to an exemplary embodiment, in preparation for returning the drill tower 26 to the drilling orientation as shown in FIG. 18 (e.g. through actuation and operation of actuators 34 in response to signals from the drilling control device 14), according to an exemplary embodiment.

Figure 19:
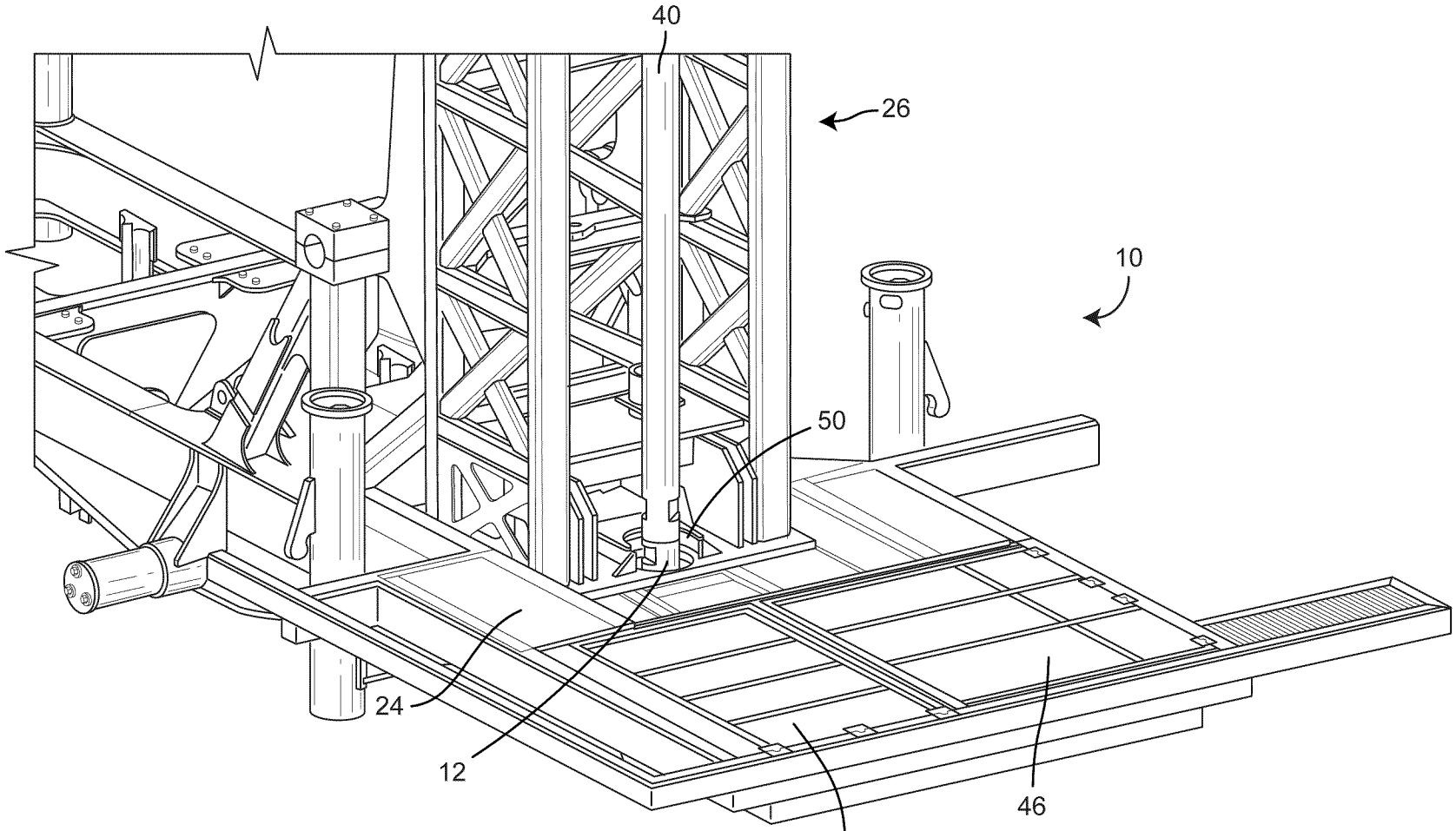
FIG. 19 is an image of a portion of the drilling rig of FIG. 1, including the drilling tool changer apparatus with the access panel for the drilling tool storage device in the closed position, and replacement drilling tool extended (e.g. lowered) to the extended position for tightening on the drill pipe, and replacement drilling tool extended to recommence the drilling operation.

Referring now to FIG. 19, with the drill tower 26 in the drilling orientation, the drill pipe 40 and replacement drilling tool 12 are extended (e.g. lowered) to the extended position for tightening on the drill pipe 40 using the hydraulically operated breakout wrench 50, the access panel 46 for the storage device 18 is moved from the open position to the closed position (using the suitable actuator 70) to complete the drilling tool change-out operation and the replacement drilling tool 12 is extended into the drill hole to re-commence the drilling operation.

Referring now to FIGS. 20-50, the drilling tool storage device 18 with the laterally translatable carriage 60 and removably replaceable cassette 20 is shown more particularly, according to an exemplary embodiment. According to the illustrated embodiment, the storage device 18 includes an outer frame 54 (e.g., pivot frame) shown in FIG. 20 as a substantially rectangular frame (i.e., substantially rectangular outer frame) having a forward (e.g. leading) end 72 that includes a hinge mechanism 74 that permits the storage device 18 to be pivotally raised about the hinge axis 58 from a stowed position located in the platform 24 up to the change-out position (e.g. at the change-out angle) to receive and cradle a used drilling tool 12. After separating the used tool 12 from the drill pipe 40 and indexing the carriage 60 (e.g. laterally translating or shifting the carriage 60 from a first position where a first [e.g. empty] storage receptacle 22 is aligned with the drill pipe 40 to receive the used tool 12, to a second position where a second [e.g. loaded] storage receptacle 22 is aligned with the drill pipe 40 to deliver the replacement tool 12), the storage device 18 is lowered about the hinge axis 58 from the change-out position back to the stowed position. The storage device 18 is also shown to include the cradle 56 (i.e., collar) (see FIG. 49) that is configured to support and facilitate alignment of the drill pipe 40 with the tool 12 and storage receptacle 22 during the tool change-out operation. The storage device 18 is further shown to include rails 42 (e.g. slide-bars, etc.) extending substantially parallel to the hinge's axis and fixed to opposite sides of the pivot frame 54. The carriage 60 includes a frame 94 having bushings 62 (see FIGS. 34-40) configured to slide along the storage device rails 42 in a low-friction manner, and the cassette 20 includes storage receptacles 22 formed from cross members 76 (shown in FIG. 20) that are sized and shaped to cradle the drilling tools 12, and having shoulders 44 (or other suitable contoured portions) configured to engage flats 48 (e.g. lands or other suitable structure) on the drilling tools 12 to prevent rotation of the tools 12 once cradled in the storage receptacle 22. The cassette 20 is also provided with suitable lifting points 64 (i.e., attachment points) (shown in FIG. 21) for attaching rigging equipment or other lifting gear (e.g. associated with a winch, lift, etc. on a service truck or the like) for removing and replacing the cassette 20 and associated drilling tools 12 stored therein. The carriage 60 also includes connectors 84 (see FIG. 36) for stabilizing connecting joints of, and/or coupling and retaining, the cassette 20. Further, the cassette 20 includes a slot 88 and a slot 90 (see FIGS. 31-33) for coupling the cassette 20 to the carriage 60.

Figure 20:
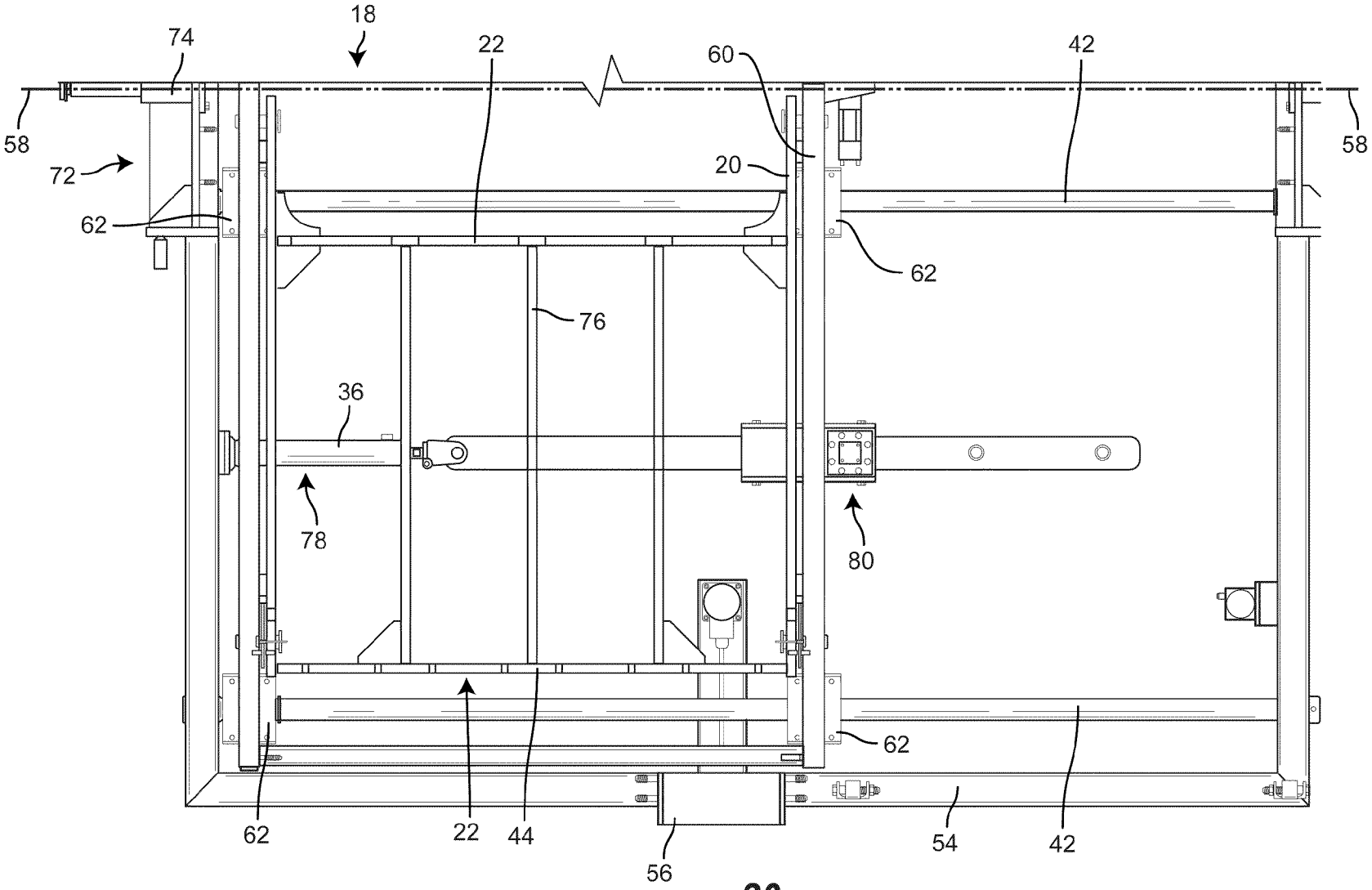
FIG. 20 is an image of the assembled drilling tool storage device for the drilling tool changer apparatus, according to an exemplary embodiment.
Figures 21, 22, 23:
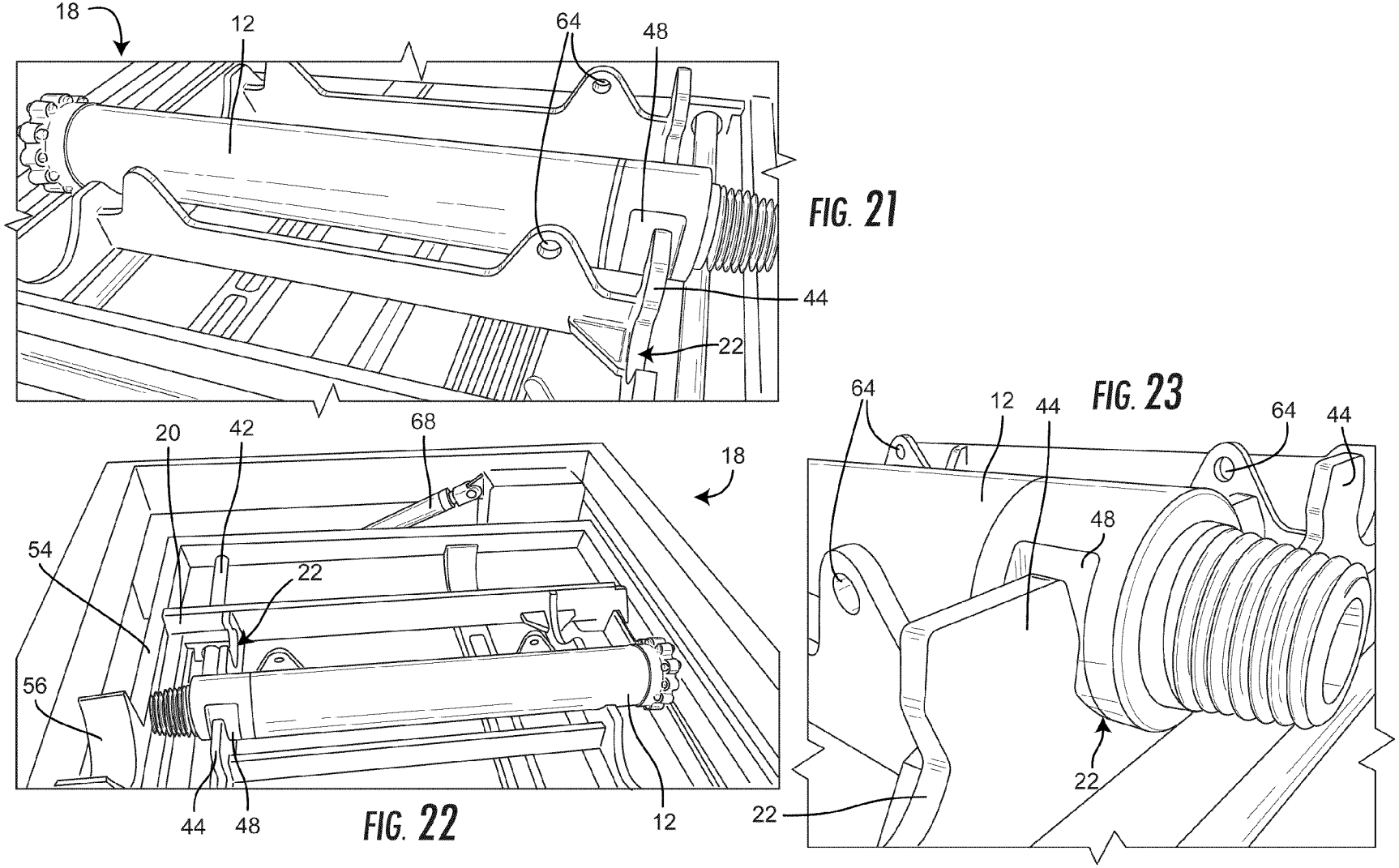
FIGS. 21-23 are images of a portion of the drilling tool storage device with drilling tools loaded in the storage cassette, according to an exemplary embodiment.

Referring further to FIGS. 20-50, the actuator 36 (e.g. hydraulic cylinder, linear actuator, rack-and-pinion, worm gear or other suitable gear system, etc.) has a first end 78 coupled to the pivot frame 54 and a second end 80 coupled to the carriage 60 (see FIG. 20). The actuator 36 is operable to extend and retract in order to laterally shift the carriage 60 along the rails 42. The actuator 36 receives suitable control signals (e.g. from the drilling control device 14, etc.) to control the travel of the carriage 60 so that it travels a predetermined distance corresponding to the location of the desired storage receptacle 22 to be aligned with the drill pipe 40. The storage device 18 may include suitable instrumentation to facilitate pivotal movement between the stowed position and the change-out position and for indexing the carriage 60 relative to the storage device 18. Such instrumentation may include (by way of example) angular transducers or position sensors, linear transducers or position sensors, limit switches, encoding devices, etc. According to one embodiment, at least some of the components of the storage device 18 and its carriage 60 are made from metal (e.g. steel, aluminum, etc.) and constructed in a robust manner (e.g. by welding or other suitable method of joining the components) that is sufficient to withstand the rigors of operation on a drilling rig 100. Referring further to FIGS.

21-23, an image of various drilling tools 12 loaded in the storage receptacles 22 of a cassette 20 is shown according to an exemplary embodiment.

Figure 51:
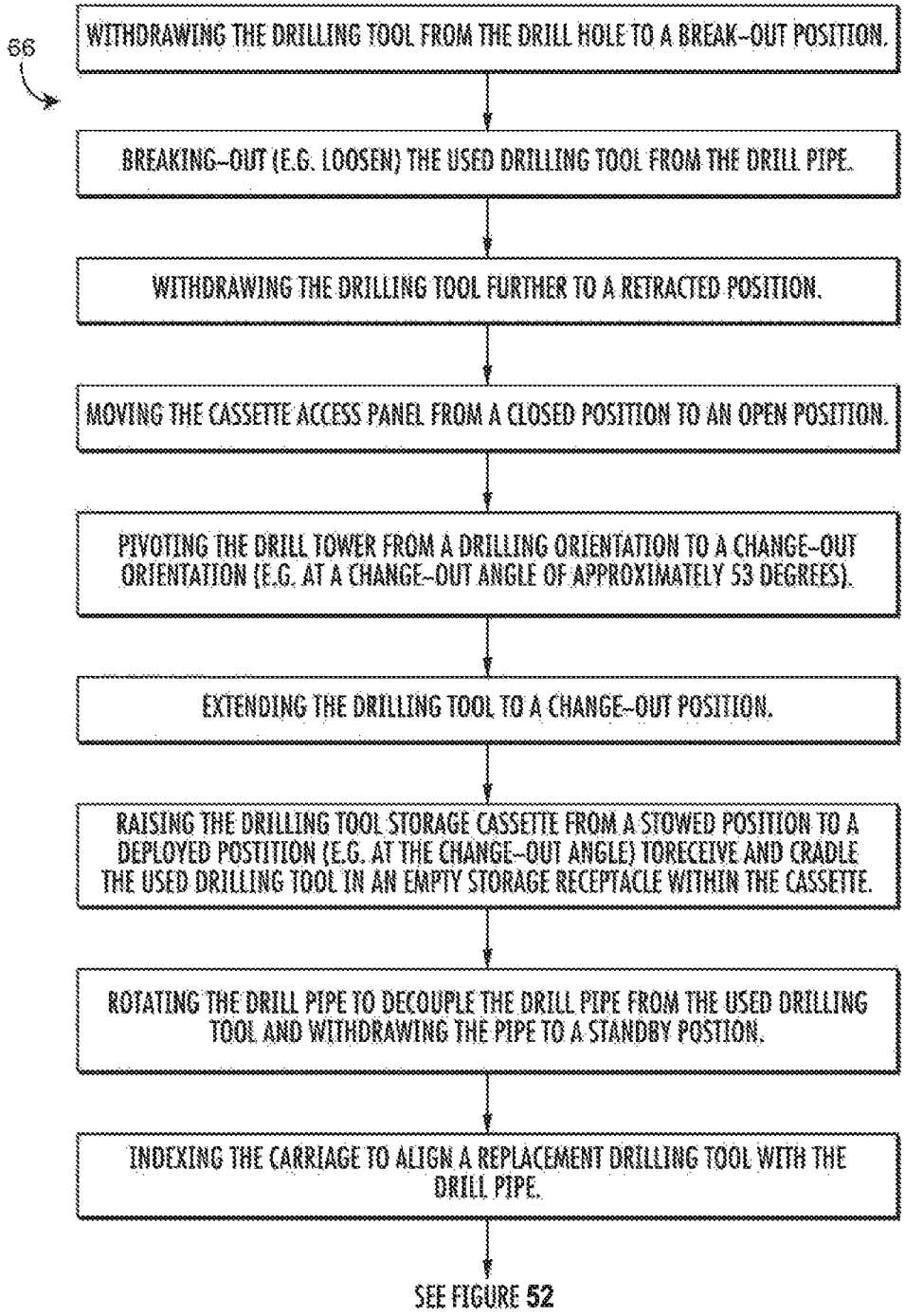
FIGS. 51 and 52 are a flowchart of a series of steps associated with a method of operating the drilling tool changer apparatus, according to an exemplary embodiment.
Figure 52:
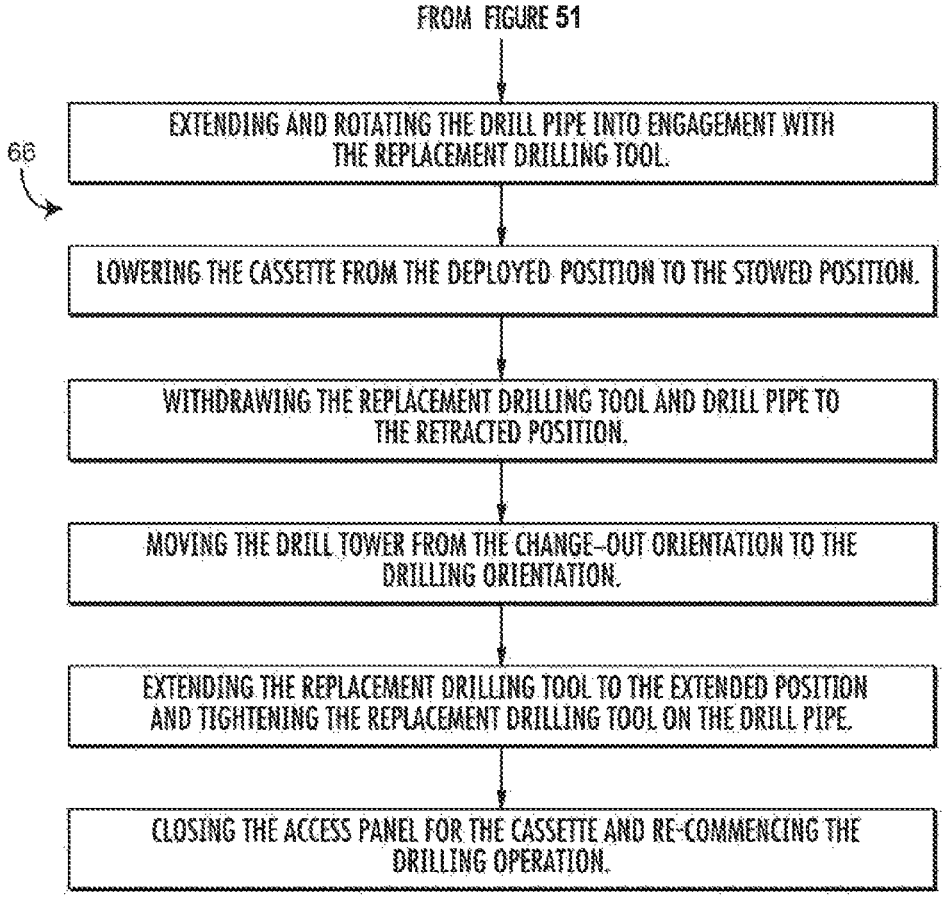

Referring to FIGS. 51 and 52, a flowchart 66 of a series of steps associated with a method of operating the drilling tool changer apparatus 10 is shown according to an exemplary embodiment. One method of operating the drilling tool changer apparatus 10 may be accomplished substantially automatically (or semi-automatically) through the use of a suitable computing device (not shown), such as (but not limited to) a hand-held computing device having a touchscreen or other suitable user interface and capable of wirelessly communicating with sensors, actuators and other components of the drill changer apparatus 10.

According to an exemplary embodiment, an apparatus and method for automatically or semi-automatically changing-out drilling tools 12 is provided that includes a pivotally movable drill tower 26 that cooperates in coordination with a pivotable drilling tool storage device 18 having a laterally translatable carriage 60 with a cassette 20 incorporating storage receptacles 22 to receive the used tools 12 from the drill pipe 40 and to present replacement tools 12 for attachment to the drill pipe 40. The apparatus 10 may be operated according to a control scheme having a number of method steps for positioning and rotating the drill pipe 40, operating a breakout wrench 50 on the drill platform 24, and pivotally moving the storage device 18 and laterally indexing the carriage 60 for the cassette 20 to receive used tools 12 from the drill pipe 40 and present replacement tools 12 to the drill pipe 40. The control scheme may be implemented using any suitable computing device with an appropriate user interface such as a touchscreen to permit input of desired information (e.g. which replacement tool to use, when to initiate change-out, etc.) and appropriate software to store and implement the steps of the control scheme, and to communicate (e.g. wirelessly, etc.) with the apparatus 10 to provide operating instructions to the apparatus 10 and to receive feedback from the apparatus 10.

The construction and arrangement of the apparatus and method for drilling tool changer, as shown in the various exemplary embodiments, is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

INDUSTRIAL APPLICABILITY

The disclosed drilling tool changer apparatus and method may be utilized in any drilling application or operation, including but not limited to mining, blast hole drilling petroleum operations or exploration, etc. The apparatus and method are intended to reduce the downtime associated with changing drilling tools on a drilling rig, and to minimize the need for personnel to manually and mechanically operate components of the drilling rig in order to accomplish the tool change.

It will be apparent to those skilled in the art that various modifications and variations can be made to the disclosed drilling tool changer apparatus and method. Other embodiments will be apparent to those skilled in the art from consideration of the specification and practice of the disclosed drilling tool changer apparatus and method. It is intended that the specification and examples be considered as exemplary only, with a true scope being indicated by the following claims and their equivalents.

What is claimed is:

1. A drilling tool changer apparatus for a drilling rig, the drilling tool changer apparatus comprising:

a drill tower pivotable between a drilling orientation and a change-out orientation, the drill tower supporting a drill string comprising a drill pipe coupled to a drilling tool; and a drilling tool storage device pivotally movable about a hinge axis between a stowed position and a deployed position, the drilling tool storage device comprising a drilling tool storage cassette including a replacement drilling tool;

wherein the drilling tool storage device and the drill tower are pivotally alignable in a substantially co-planar manner when the drilling tool storage device is in the deployed position and the drill tower is in the change-out orientation, wherein the drilling tool storage device includes a laterally translatable carriage having a storage receptacle for supporting the replacement drilling tool, so that the storage receptacle can be indexed into and out of coaxial alignment with the drill pipe during a change-out operation, and wherein the drilling tool storage cassette is removably coupled to the laterally translatable carriage.

2. The drilling tool changer apparatus of claim 1, further comprising:

a drilling control device configured to communicate with the drill tower and the drilling tool storage device;

wherein the drilling tool storage device and the drill tower are at least semi-automated to change out the drilling tool for the replacement drilling tool in response to instructions from the drilling control device.

3. The drilling tool changer apparatus of claim 2, wherein the drilling control device includes a programmable logic controller and a computer-based user interface.

4. The drilling tool changer apparatus of claim 1, wherein the drilling tool storage cassette is configured to accommodate combined storage of rotary drilling bits and hammer drilling bits of various sizes.

5. The drilling tool changer apparatus of claim 1, wherein the drilling tool storage device includes an actuator coupled to the laterally translatable carriage for indexing the storage receptacle.

6. The drilling tool changer apparatus of claim 1, wherein the storage receptacle includes an anti-rotation element to substantially prevent rotation of the replacement drilling tool while within the storage receptacle.

7. The drilling tool changer apparatus of claim 1, further comprising a cover panel being deployable between an open position and a closed position as needed to permit the drilling tool and the replacement drilling tool to be attached and detached from the drill pipe.

8. The drilling tool changer apparatus of claim 7, wherein the cover panel in the closed position provides a substantially uniform work surface on a platform of the drilling rig, covering the drilling tool storage device to protect the drilling tool storage device from contaminants and damage.

9. The drilling tool changer apparatus of claim 7, wherein the cover panel is deployed between the open position and the closed position by an actuator coupled to the cover panel.

10. The drilling tool changer apparatus of claim 1, wherein the drilling tool storage device has a low profile and fits beneath a platform of the drilling rig adjacent to the drill tower when in the stowed position.

11. A drilling tool storage device, comprising:

a substantially rectangular outer frame having a hinge mechanism that permits the drilling tool storage device to be pivotally raised about a hinge axis between a stowed position and a change-out position;

rails extending substantially parallel to the hinge axis and fixed to opposite sides of the substantially rectangular outer frame;

a laterally translatable carriage coupled to the rails;

a storage cassette removably coupled to the laterally translatable carriage and having a storage receptacle supporting a replacement drilling tool;

an actuator operable to extend and retract in order to shift the laterally translatable carriage along the rails; and a cradle configured to support and facilitate alignment of a drill pipe with the replacement drilling tool and the storage receptacle during a change-out operation, wherein the laterally translatable carriage includes attachment points for removing and replacing the storage cassette.

12. The drilling tool storage device of claim 11, wherein the storage cassette is configured to accommodate combined storage of rotary drilling bits and hammer drilling bits of various sizes.

13. The drilling tool storage device of claim 11, wherein the storage cassette includes an anti-rotation element to substantially prevent rotation of the replacement drilling tool while within the storage receptacle.

14. The drilling tool storage device of claim 13, wherein the anti-rotation element includes a shoulder configured to engage a flat on the replacement drilling tool to prevent the rotation of the replacement drilling tool.

15. The drilling tool storage device of claim 11, wherein the actuator is operable to index the storage receptacle and the replacement drilling tool into coaxial alignment with the drill pipe during the change-out operation.

16. The drilling tool storage device of claim 11, further comprising bushings coupled to the laterally translatable carriage and configured to slide along the rails in a low-friction manner.

17. The drilling tool storage device of claim 11, further comprising a second actuator coupled to the substantially rectangular outer frame for pivotally raising the substantially rectangular outer frame about the hinge axis.

18. A method for changing a drilling tool for a drilling rig, the method comprising:

withdrawing a drill pipe coupled to a used drilling tool away from a drill hole to a break-out position;

loosening the used drilling tool from the drill pipe;

withdrawing the drill pipe and the used drilling tool further away from the drill hole to a retracted position;

moving a cover panel from a closed position to an open position;

pivoting the drill pipe from a drilling orientation to a change-out orientation;

extending the drill pipe and the used drilling tool to a change-out position;

raising a drilling tool storage device from a stowed position to a deployed position to receive the used drilling tool in an empty storage receptacle within the drilling tool storage device;

rotating the drill pipe to de-couple the drill pipe from the used drilling tool;

withdrawing the drill pipe to a standby position;

indexing a carriage to align a replacement drilling tool with the drill pipe;

extending and rotating the drill pipe into engagement with the replacement drilling tool;

lowering the drilling tool storage device from the deployed position to the stowed position;

withdrawing the drill pipe and the replacement drilling tool to the retracted position;

moving the drill pipe from the change-out orientation to the drilling orientation;

extending the drill pipe and the replacement drilling tool to an extended position and tightening the replacement drilling tool on the drill pipe; and moving the cover panel from the open position to the closed position and re-commencing a drilling operation.

* * * * *